US011313225B2

(12) United States Patent
Zainalabedin et al.

(10) Patent No.: US 11,313,225 B2
(45) Date of Patent: Apr. 26, 2022

(54) CORING METHOD AND APPARATUS

(71) Applicant: Saudi Arabian Oil Company, Dhahran (SA)

(72) Inventors: Khalid A Zainalabedin, Al-Khobar (SA); Mustafa A. Al-Huwaider, Dhahran (SA); Shouxiang Mark Ma, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/005,052

(22) Filed: Aug. 27, 2020

(65) Prior Publication Data

US 2022/0065104 A1 Mar. 3, 2022

(51) Int. Cl.
*E21B 49/06* (2006.01)
*E21B 44/00* (2006.01)

(52) U.S. Cl.
CPC ..... *E21B 49/06* (2013.01); *E21B 44/005* (2013.01)

(58) Field of Classification Search
CPC ..... E21B 49/06; E21B 25/00
See application file for complete search history.

(56) References Cited

U.S. PATENT DOCUMENTS 2,372,875 A * 4/1945 Benke ..... E21B 49/06 175/78
2,852,230 A 9/1958 Garrison
3,150,727 A * 9/1964 Garrison ..... E21B 49/06 175/78
3,353,612 A * 11/1967 Bannister ..... E21B 49/06 175/6
4,929,113 A 5/1990 Sheau
5,531,112 A 7/1996 Young et al.
5,667,025 A * 9/1997 Haessly ..... E21B 49/06 175/78
5,746,279 A * 5/1998 Havlinek ..... E21B 7/061 175/52
6,028,307 A 2/2000 Young et al.
7,703,317 B2 4/2010 Goodwin et al.
7,789,170 B2 9/2010 Church
8,109,140 B2 2/2012 Tustin et al.
(Continued)

FOREIGN PATENT DOCUMENTS

CN 102619484 8/2012
EP 0514657 4/1992
WO WO 2014012781 1/2014

OTHER PUBLICATIONS

"CoreVault Rock-Fluid-Pressure (RFP) Sampling System," Halliburton, 2017, 2 pages.
(Continued)

*Primary Examiner* — Shane Bomar
(74) *Attorney, Agent, or Firm* — Fish & Richardson P.C.

(57) ABSTRACT

A system includes a bottom hole assembly and a core sampling tool. The bottom hole assembly includes a housing and a drill bit coupled to the housing. The core sampling tool includes a first compartment positioned within the housing, the first compartment including a motor; a second compartment positioned within the housing and radially spaced apart from the first compartment, the second compartment including a coring bit; and a flexible drilling shaft extending between and coupled to the motor and the coring bit.

19 Claims, 18 Drawing Sheets

(56) References Cited

U.S. PATENT DOCUMENTS

| | | | | |
|---|---|---|---|---|
| 8,496,054 | B2 | 7/2013 | Zazovsky et al. | |
| 8,550,184 | B2 | 10/2013 | Buchanan et al. | |
| 8,978,481 | B2 | 3/2015 | Powell et al. | |
| 9,383,476 | B2 | 7/2016 | Trehan et al. | |
| 10,316,648 | B2 | 6/2019 | Swett | |
| 10,545,129 | B2 | 1/2020 | Nguyen et al. | |
| 2002/0005286 | A1 | 1/2002 | Mazorow et al. | |
| 2006/0000606 | A1* | 1/2006 | Fields | E21B 43/112 166/264 |
| 2006/0081398 | A1* | 4/2006 | Arian | E21B 49/06 175/58 |
| 2008/0066536 | A1 | 3/2008 | Goodwin et al. | |
| 2009/0008079 | A1 | 1/2009 | Zazovsky et al. | |
| 2009/0159278 | A1 | 6/2009 | Corre et al. | |
| 2011/0272150 | A1 | 11/2011 | Ives et al. | |
| 2012/0312530 | A1 | 12/2012 | Pope et al. | |
| 2013/0020128 | A1 | 1/2013 | Calleri | |
| 2013/0081879 | A1 | 4/2013 | Ward et al. | |
| 2013/0175036 | A1 | 7/2013 | Hausot | |
| 2014/0131033 | A1* | 5/2014 | Galvan-Sanchez | E21B 49/06 166/250.01 |
| 2016/0273292 | A1* | 9/2016 | Morgan | E21B 25/10 |
| 2016/0326866 | A1 | 11/2016 | Swett | |
| 2019/0129056 | A1 | 5/2019 | Rasmus et al. | |
| 2019/0277806 | A1 | 9/2019 | Huang | |
| 2020/0003599 | A1 | 1/2020 | Theuveny et al. | |

OTHER PUBLICATIONS

Abernethy, "Production increase of heavy oils by electromagnetic heating," Journal of Canadian Petroleum Technology, Jul.-Sep. 1976, 8 pages.

Allied Horizontal Wireline Services, "Multi-arm Caliper MAC 40," retrieved from URL <https://horizontalwireline.com/wp-content/uploads/2014/09/AHWS-Multi-Arm_Caliper.pdf>, retrieved on Feb. 12, 2020, available on or before 2014, 2 pages.

Almansour and Al-Bassaz, "Physical and Chemical characterization and evaluation of organic matter from tar-mat samples: Case Study of Kuwaiti Carbonate Reservoir," Journal of Chemical Technology App 1:1, Sep. 2017, 12 pages.

Alomair et al., "Viscosity Prediction of Kuwaiti Heavy Crudes at Elevated Temperatures," SPE 150503, Society of Petroleum Engineers (SPE), presented at the SPE Heavy Oil Conference and Exhibition, Kuwait, Dec. 12-14, 2011, 18 pages.

bakerhughes.com [online] "VACS G2 system," Baker Hughes, available on or before Oct. 5, 2020, retrieved on Jan. 7, 2021, retrieved from URL <https://www.bakerhughes.com/wellbore-cleanup/vacs-g2-system>, 5 pages.

bakerhughes.com [online] "Vectored annular cleaning system (VACS) technology," Baker Hughes, available on or before Oct. 5, 2020, retrieved on Jan. 7, 2021, retrieved from URL https://www.bakerhughes.com/wellbore-cleanup/vectored-annular-cleaning-system-vacs-technology, 4 pages.

Bauldauff et al., "Profiling and quantifying complex multiphase flow," Oilfield Review, Autumn 2004, 10 pages.

Bermudez et al., "Assisted Extra Heavy Oil Sampling by Electromagnetic Heating," SPE 171073-MS, Society of Petroleum Engineers (SPE), presented at the SPE Heavy and Extra Heavy Oil Conference—Latin American, Colombia, Sep. 24-26, 2014, 13 pages.

Bristow et al., "Measurement of Soil Thermal Properties with a Dual-Probe Heat-Pulse Technique," Soil Sci. Soc. Am. J. 58:1288-1294, Sep. 1994, 7 pages.

glossary.oilfield.slb.com [online], "Distributed temperature log," retrieved from URL <https://www.glossary.oilfield.slb.com/en/Terms/d/distributed_temperature_log.aspx>, retrieved on Feb. 12, 2020, available on or before 2020, 1 page.

halliburton.com, [online], "CoreVault System," available on or before 2020, retrieved on Nov. 9, 2020, retrieved from URL <https://www.halliburton.com/en-US/ps/wireline-perforating/wireline-and-perforating/open-hole-logging/sidewall-coring/corevault.html>, 2 pages.

Liu, "Acoustic Properties of Reservoir Fluids," A Dissertation Submitted to the Department of Geophysics and Committee on Graduate Studies of Stanford University in Partial Fulfillment of the Requirements for the Degree of Doctor of Philosophy, Jun. 1998, 111 pages.

McCoy et al., "Analyzing Well Performance VI," Southwestern Petroleum Short Course Association, Lubbock, 1973, 9 pages.

Meter Environment [online], "Thermal Properties: Why the TEMPOS method outperforms other techniques," retrieved from URL <https://www.metergroup.com/environment/articles/thermal-properties-transient-methodoutperforms-techniques/>, retrieved on Feb. 12, 2020, available on or before 2020, 6 pages.

Mohamed et al., "Leak Detection by Temperature and Noise Logging," Society of Petroleum Engineers, Abu Dhabi International Petroleum Conference and Exhibition, Nov. 11-14, 2012, Abu Dhabi, UAE, abstract retrieved from URL <https://archive.is/20130628032024/http://www.onepetro.org/mslib/servlet/onepetropreview#selection-191.0-191.96>, retrieved on Feb. 12, 2020, 2 pages, Abstract Only.

Moses, "Geothermal Gradients," Drilling & Production Practice, Core Lab. Inc., Dallas, Texas, 1961, 7 pages.

oilproduction.net [online], "Acoustic Velocity for Natural Gas," retrieved on Jan. 7, 2021, URL <http://oilproduction.net/files/Acoustic%20Velocity%20for%20Natural%20Gas.pdf>, 6 pages.

Proactive Diagnostic Services, "Multiple-Array Production Suite (MAPS)," 2017, 2 pages.

Schlumberger, "PS Platform, Production services platform," retrieved from URL <https://www.slb.com/-/media/files/production/product-sheet/ps_platform_ps.ashx>, retrieved on Feb. 12, 2020, available on or before 2014, 3 pages.

slb.com [online] "Well Scavenger," Schlumberger, available on or before Aug. 3, 2020, via Internet Archive: Wayback Machine URL <http://web.archive.org/web/20200803130523/https://www.slb.com/completions/fluids-and-tools/wellbore-cleaning-tools/debris-recovery-tools/well-scavenger-vacuum-debris-removal-tool>, retrieved on Jan. 12, 2021, URL <https://www.slb.com/completions/fluids-and-tools/wellbore-cleaning-tools/debris-recovery-tools/well-scavenger-vacuum-debris-removal-tool>, 5 pages.

Thomas et al., "Determination of Acoustic Velocities for Natural Gas," SPE 2579, Society of Petroleum Engineers (SPE), Journal of Petroleum Technology, Jul. 1970, 22(7):889-895, 7 pages.

Wang et al., "Acoustic Velocities in Petroleum Oils," SPE 18163 MS/ SPE 18163 PA, Society of Petroleum Engineers (SPE), presented at the SPE Annual Technical Conference and Exhibition, Oct. 2-5, 1988, 15 pages.

wildcatoiltools.com [online] "HydroVortex," Wildcat Oil Tools, available on or before Oct. 5, 2020, retrieved on Jan. 12, 2021, retrieved from URL <https://www.wildcatoiltools.com/hydrovortex>, 5 pages.

Wilhelms and Larter, "Origin of tar mats in petroleum reservoirs Part II: Formation mechanisms for tar mats," Marine Petroleum Geology 11:4, Aug. 1994, 15 pages.

PCT International Search Report and Written Opinion in International Appln. No. PCT/US2021/047921, dated Nov. 29, 2021.

* cited by examiner

CORING METHOD AND APPARATUS

TECHNICAL FIELD

This disclosure relates to apparatus, systems, and methods of collecting core samples, and more particularly to collecting sidewall cores while drilling.

BACKGROUND

Core data is often used as a reference for other wellbore measurements, such as for interpreting logs and well tests for lithology, porosity, permeability, wettability, fluid content, as well as fluid properties such as viscosity, density, and compressibility. As such, collecting formation core samples is a crucial part of oil and gas exploration and development. Conventional coring is typically performed by replacing a drilling bit with a coring bit when the top of a targeted zone to be cored is reached. However, this process requires pulling the drillstring out of wellbore multiple times to perform bit replacement and to perform multiple coring runs in order to capture multiple cores with a particular limited core length (such as 30 feet long).

Alternatively wireline sidewall coring tools can be used to obtain sidewall core samples at targeted intervals. However, sidewall coring using wireline tools also requires that the drilling assembly be removed from the wellbore in order to run the wireline coring tool into the wellbore, which can be time-consuming and, therefore, costly, especially in high angle and horizontal wells where wireline needs to be replaced by coil tubing or drill pipe for conveying sidewall coring tools.

In addition, in situations where borehole stability is an issue, such as wellbores containing washouts, conventional coring and wireline sidewall coring tools cannot be used to effectively capture core samples. It is also very difficult and costly to conduct conventional coring or wireline side-wall coring in highly deviated wells or horizontal wells, especially in very long total depth wells located in challenging environments such as deep water wells, for which making a trip in and out of the well can be a time consuming cost prohibitive operation.

SUMMARY

In an example implementation, a system includes a bottom hole assembly and a core sampling tool. The bottom hole assembly includes a housing and a drill bit coupled to the housing. The core sampling tool includes a first compartment positioned within the housing, the first compartment including a motor; a second compartment positioned within the housing and radially spaced apart from the first compartment, the second compartment including a coring bit; and a flexible drilling shaft extending between and coupled to the motor and the coring bit.

This, and other implementations, can include one or more of the following features. The first compartment and the second compartment can be vertically spaced apart within the housing of the bottom hole assembly. The first compartment can include a first actuator configured to raise and lower the motor within the first compartment. The second compartment can include an opening through the housing; and a sealing door configured to seal the opening; and lowering the motor within the first compartment can cause the coring bit to extend outside the second compartment through the opening when the sealing door is positioned above the opening. The second compartment can include a second actuator configured to raise and lower the sealing door within the second compartment; and positioning the sealing door above the opening can include causing the second actuator to retract a connecting rod coupled to the sealing door. The sealing door can be configured to seal the opening during drilling operations. The second compartment can include a core storage container. The coring bit can be configured to rotate to deposit a core sample within the core storage container. The coring bit can coupled to the flexible drilling shaft using one or more locking joint pins; and the second compartment can include a locking joint pin releaser configured to unlock the one or more locking joint pins coupled to the coring bit. The second compartment can include a rotatable actuator configured to rotate the coring bit within the second compartment. Rotating the coring bit to deposit core samples within the core storage container can include inserting the one or more locking joint pins into the locking joint pin releaser to unlock the one or more locking joint pins; and actuating the rotatable actuator to rotate the coring bit within the second compartment. The second compartment can include a second connecting rod coupled to the rotatable actuator; and a rotatable bit housing coupled to the rotatable actuator, the rotatable bit housing encircling the coring bit when the coring bit is positioned with the second compartment; and actuating the rotatable actuator to rotate the coring bit within the second compartment can include causing the actuator to extend the second connecting rod. The second compartment can include a third actuator; and a core disposing pin coupled to the third actuator. Depositing the core sample within the core storage container can include rotating the coring bit from a neutral position to a depositing position over the core storage container; and extending the core disposing pin using the third actuator through the coring bit. The second compartment can include a fourth actuator; and a plug coupled the fourth actuator and configured to seal the core storage container. Sealing the core storage container can include determining that the core storage container is full; in response to determining that the core storage container is full, actuating the fourth actuator to position the plug over the core storage container; and inserting the plug into the core storage container. Inserting the plug into the core storage container can include extending the core disposing pin using the third actuator to press the plug into the core storage container. The system can include an anchor shoe configured to stabilize the bottom hole assembly within a wellbore; and a third compartment within the housing, the third compartment including a fifth actuator; a first leg rotatably coupled to the anchor shoe and the fifth actuator; and a second leg rotatably coupled to the anchor shoe and the third compartment. The third compartment can be vertically spaced apart from the first compartment and the second compartment and radially spaced apart from the second compartment within the housing.

In some implementations, a core sampling tool includes a first compartment positioned within a housing, the first compartment including a motor; a second compartment positioned within the housing and radially spaced apart from the first compartment, the second compartment including a coring bit; and a flexible drilling shaft extending between and coupled to the motor and the coring bit. The coring bit is configured to cut core samples from a targeted formation.

Example embodiments of the present disclosure may include one, some, or all of the following features. For example, a core sampling tool according to the present disclosure may be used during drilling operations without requiring removal of the drilling tool from the wellbore. As a result, a core sampling tool according to the present disclosure may reduce the time and cost required to collect core samples by allowing for core sampling during drilling operations. In addition, a core sampling tool according to present disclosure may minimize flow restrictions along the drill pipe as a result of the radially offset chambers of the core sampling tool. A core sampling tool according to the present disclosure may also allow for sampling in deeper portions of a formation compared to sampling with traditional sampling tools. A core sampling tool according to the present disclosure may enable core sampling in highly deviated wells and/or horizontal wells. In addition, a core sampling tool according the present disclosure may allow for core sampling in boreholes with stability problems, such as wellbores with borehole washouts.

The details of one or more embodiments are set forth in the accompanying drawings and the description below. Other features, objects, and advantages will be apparent from the description and drawings, and from the claims.

DETAILED DESCRIPTION

The present disclosure describes a sidewall core sampling tool and system for capturing one or more core samples from a wellbore.

Figure 1:
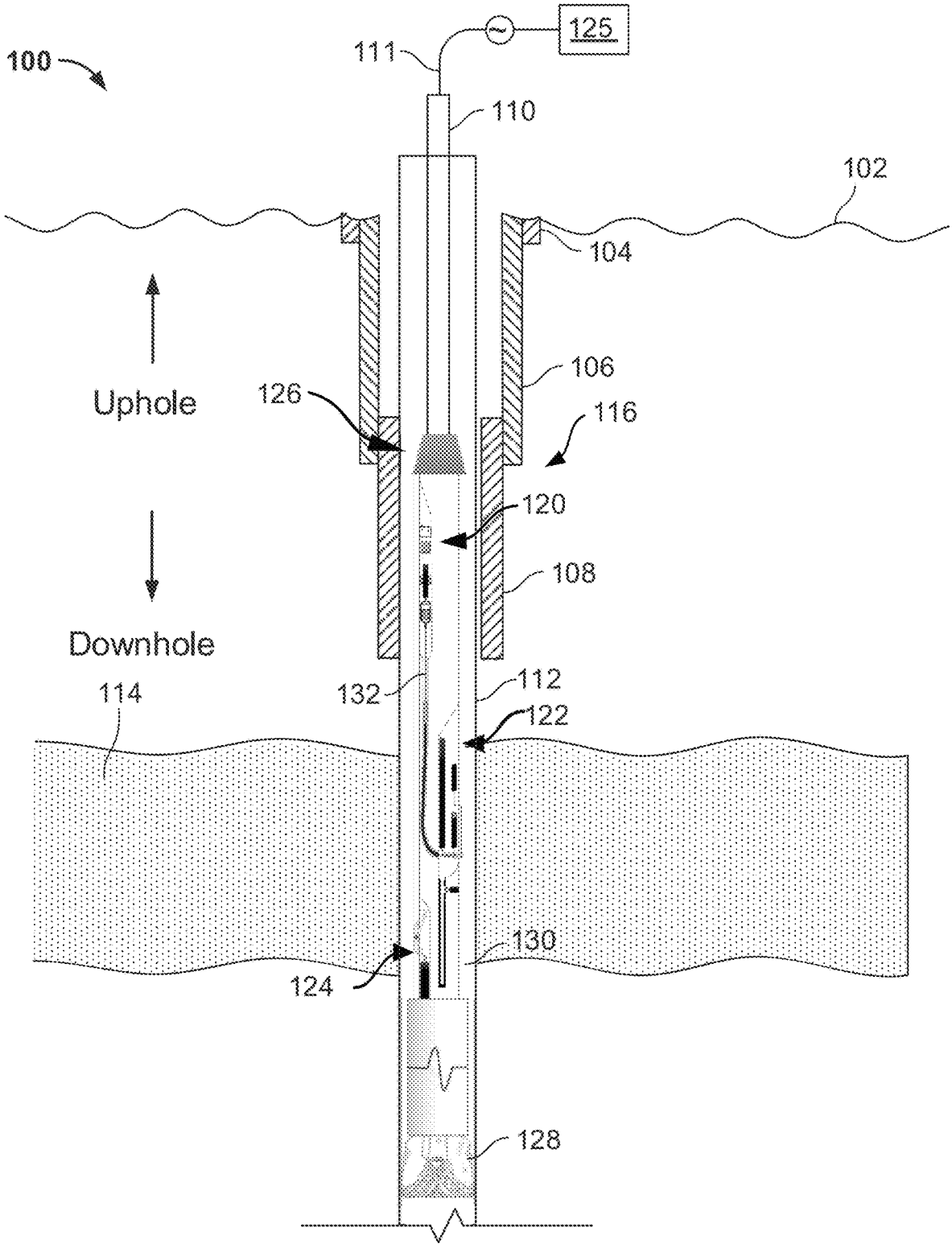
FIG. 1 is schematic illustration of a wellbore system that includes an example implementation of a sidewall core sampling tool according to the present disclosure.

FIG. 1 is a schematic illustration of an example wellbore system 100 including a sidewall core sampling tool 116. As can be seen in FIG. 1, the sidewall core sampling tool 116 is coupled to a bottom hole assembly 126. As illustrated in FIG. 1, an implementation of the wellbore system 100 includes a drillstring 110 that is operable to convey (for example, run in, or pull out, or both) the bottom hole assembly 126 and sidewall core sampling tool 116 through a wellbore 112.

The bottom hole assembly 126 coupled with the drillstring 110 may be used to form the wellbore 112. The wellbore 112 may be formed to extend from the terranean surface 102 through one or more geological formations in the Earth. One or more subterranean formations, such as subterranean zone 114, are located under the terranean surface 102. One or more wellbore casings, such as surface casing 106 and intermediate casing 108, may be installed in at least a portion of the wellbore 112.

Although shown as a wellbore 112 that extends from land, the wellbore 112 may be formed under a body of water rather than the terranean surface 102. For instance, in some embodiments, the terranean surface 102 may be a surface under an ocean, gulf, sea, or any other body of water under which hydrocarbon-bearing, or water-bearing, formations may be found. In short, reference to the terranean surface 102 includes both land and underwater surfaces and contemplates forming or developing (or both) one or more wellbores 112 from either or both locations.

As depicted in FIG. 1, the wellbore 112 includes a vertical wellbore section. In alternative aspects, the wellbore 112 may be directional, vertical, horizontal, curved, multi-lateral, or other forms.

In some aspects, the drillstring 110 may be a tubular work string made up of multiple tubing joints. For example, a tubular work string typically consists of sections of steel pipe, which are threaded so that they can interlock together.

Once the wellbore 112 is formed (or in some cases during portions of forming the wellbore 112), one or more tubular casings may be installed in the wellbore 112. As illustrated, the wellbore 112 includes a conductor casing 104, which extends from the terranean surface 102 shortly into the Earth. A portion of the wellbore 112 enclosed by the conductor casing 104 may be a large diameter borehole.

Downhole of the conductor casing 104 may be the surface casing 106. The surface casing 106 may enclose a slightly smaller borehole and protect the wellbore 112 from intrusion of, for example, freshwater aquifers located near the terranean surface 102. The wellbore 112 may then extend vertically downward and/or horizontally outward. This portion of the wellbore 112 may be enclosed by the intermediate casing 108. In some aspects, the location in the wellbore 112 at which the sidewall core sampling tool 116 is moved to may be an open hole portion (for example, with no casing present) of the wellbore 112.

As depicted in FIG. 1, the bottom hole assembly 126 includes a housing 130 and a drill bit 128 coupled to an end of the housing 130. The drill bit 128 can be used to form a wellbore 112. The sidewall core sampling tool 116 is contained within the housing 130 of the bottom hole assembly 126 and, as a result, is conveyed through the wellbore 112 as the drilling assembly 126 moves through the formation 114 to extend and form the wellbore 112.

Figure 2:
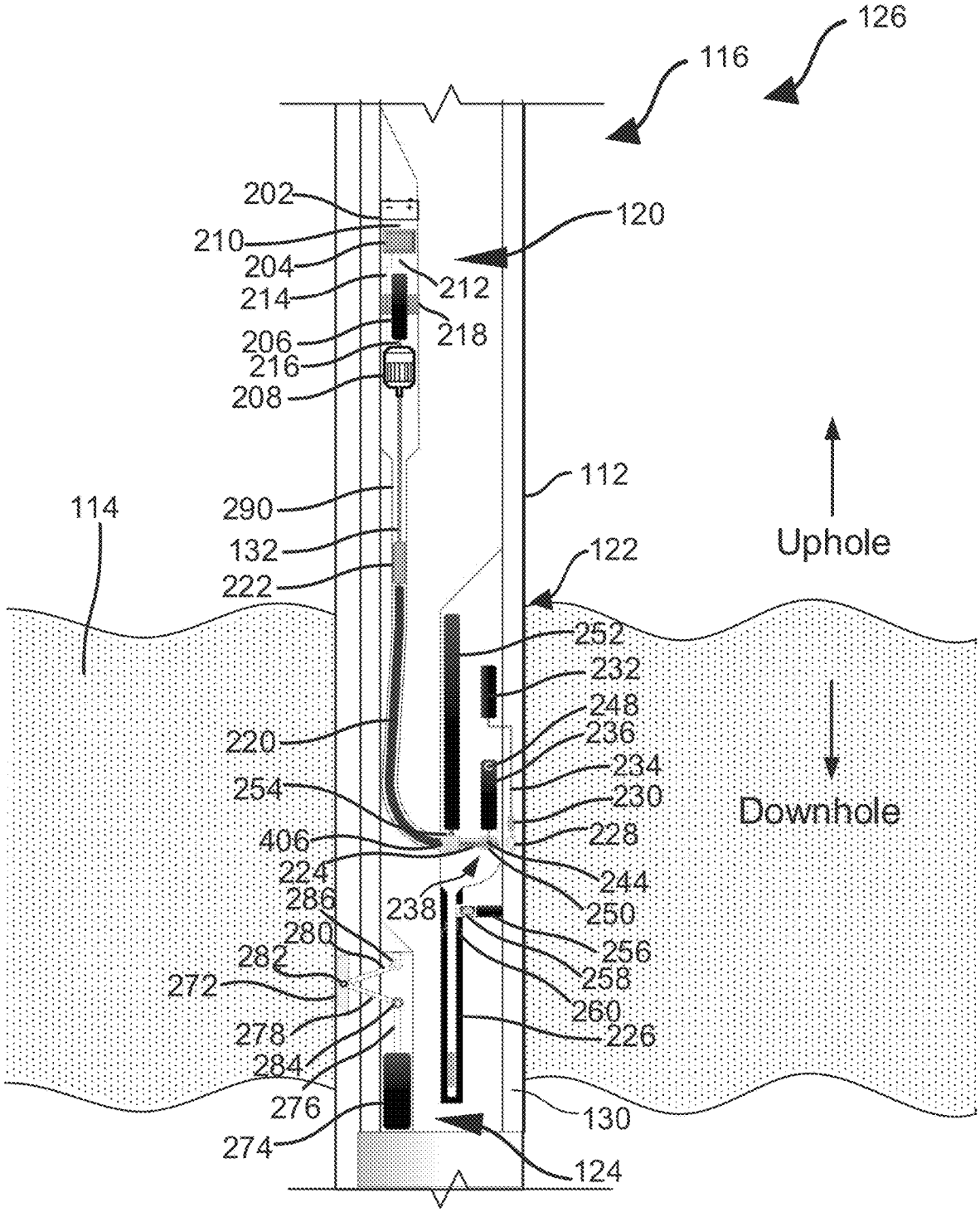
FIG. 2 is a detailed view of the sidewall core sampling tool of FIG. 1 with a coring bit in a first position.

As shown in FIGS. 1 and 2, the sidewall core sampling tool 116 includes a first compartment 120, a second compartment 122, and a third compartment 124. As will be described in further detail herein the first compartment 120 and the second compartment 122 are coupled by a flexible drilling shaft 132. As can be seen in FIGS. 1 and 2, each of the compartments 120, 122, 124 are spaced apart from each other along the length of the housing 130 of the bottom hole assembly 126, and the second compartment 122 is radially offset from the first compartment 120 and the third compartment 124

As illustrated in FIG. 1, the sidewall core sampling tool 116 is communicably coupled to a control system 125 through a control line 111, which, in this example, is located at the terranean surface 102. In some implementations, the control system 125 communicates with and operates the drilling assembly 126 using one or more of mud-pulse telemetry, electromagnetic telemetry, or wired drill pipe.

The control system 125 may be a microprocessor-based, mechanical, or electromechanical controller, as some examples. The control system 125, in some aspects, may send and receive data between it and the sidewall core sampling tool 116, as well as, for example, provide electrical power to the sidewall core sampling tool 116. The control system 125 may perform one or more operations described in the present disclosure to operate all or parts of the sidewall core sampling tool 116. In some implementations, the control system 125 is a computer-readable medium (for example, a non-transitory computer-readable medium) storing instructions executable by one or more processors to perform operations described in this disclosure. In some implementations, the control system 125 includes firmware, software, hardware, processing circuitry or combinations of them that can perform operations described in this disclosure.

Referring to FIG. 2, the first compartment 120 of the sidewall core sampling tool 116 houses a battery 202, a computer 204, an actuator 206, and an electric motor 208. The computer 204, actuator 206, and motor 208 are each electrically coupled to the battery 202 using a series of wires 210, 212, 214. The battery 202, is configured to provide electrical power to each component of the sidewall core sampling tool 116, including the computer 204 and the motor 208. In addition, the computer 204 can be communicably coupled to each of the electrical components of the sidewall core sampling tool 116 in order to control and coordinate the electrical components of the sidewall core sampling tool 116.

As depicted in FIG. 2, the motor 208 is connected to the actuator 206 by a connecting rod 216. The actuator 206 can be controlled to extend and retract the connecting rod 216, which causes the motor 208 to move vertically within the first compartment 120. As will be described in further detail herein, vertical movement of the motor 208 via extension of the connecting rod 216 by actuator 206 is converted into horizontal movement of a coring bit 224 in the second compartment 122 as a result of the connection of a flexible drilling shaft 132 between the motor 208 and the coring bit 224.

In some implementations, the first compartment 120 includes a seal 218 that is positioned around the actuator 206. The seal 218 is positioned to seal off and prevent fluid from contaminating the computer 204 and the battery 202.

As can be seen in FIG. 2, the flexible drilling shaft 132 extends from the motor 208 contained in the first compartment 120, through a linear bearing 220, to the coring bit 224 contained in the second compartment 122. The linear bearing 220 can be configured to bend the flexible drilling shaft 132. For example, as depicted in FIG. 2, the linear bearing 220 is curved, which helps bend the flexible drilling shaft 132 from a vertical orientation relative to the housing 130 of the bottom hole assembly 126 to a horizontal orientation as the drilling shaft 132 approaches the second compartment 122. The linear bearing 220 also helps provide smooth sliding and rotation of the drilling shaft 132 as it is moved and rotated by the motor 208. In some implementations, the first compartment 120 and the second compartment 122 are connected by a tube 290 that houses the linear bearing 220 and flexible shaft 132.

As depicted in FIG. 2, a rubber seal 222 is provided around the drilling shaft 132 between the motor 208 and the linear bearing 220. The rubber seal 222 prevents fluids from contaminating the components contained within the first compartment 120. Still referring to FIG. 2, the second compartment 122 includes a coring bit 224 coupled to the flexible drilling shaft 132 and a core storage container 226.

The coring bit 224 is configured to collect sidewall core samples from the surrounding wellbore 112. As will be described in further detail herein, as the drilling shaft 132 is lowered and rotated by the motor 208, the coring bit 224 is simultaneously pushed laterally outside the housing 130 through an opening 228 in the housing 130 towards the surface of the wellbore 112 and is rotated to cut a core sample from the subterranean zone 114. In some implementations, the coring bit 224 is a hollow bit that includes a central opening that extends along the length of the coring bit 224, and core samples are collected within the central opening of the coring bit 224.

In some implementations, the core sampling tool 116 includes a sealing door 230 that is configured to selectively cover and uncover the opening 228 in the housing 130 proximate the second compartment 122. For example, as depicted in FIG. 2, the sealing door 230 is connected to a fixed actuator 232 by a connecting rod 234, and as the fixed actuator 232 is actuated, the connecting rod 234 is extended to lower the sealing door 230 over the opening 228. By positioning the sealing door 230 over the opening 228 during drilling operations to seal the second compartment 122, the sealing door 230 prevents contamination of the coring equipment contained within the second compartment 122 resulting from contact with drilling fluids and cuttings within the wellbore 112. For example, as depicted in FIG. 1, while the drilling bit 128 of the bottom hole assembly 126 is being operated to extend the wellbore 112 downhole, the sealing door 230 can be lowered by the actuator 232 to prevent fluids or cuttings from entering the second compartment 122 through the opening 228 in the housing 130. As depicted in FIG. 2, when sampling operations are being conducted, sealing door 230 can be raised by the actuator 232 to expose the opening 228 and allow the coring bit 224 to extend outside the housing 130 through the opening 228 and access the wellbore 112 to collect core samples from the subterranean zone 114.

Figure 3:
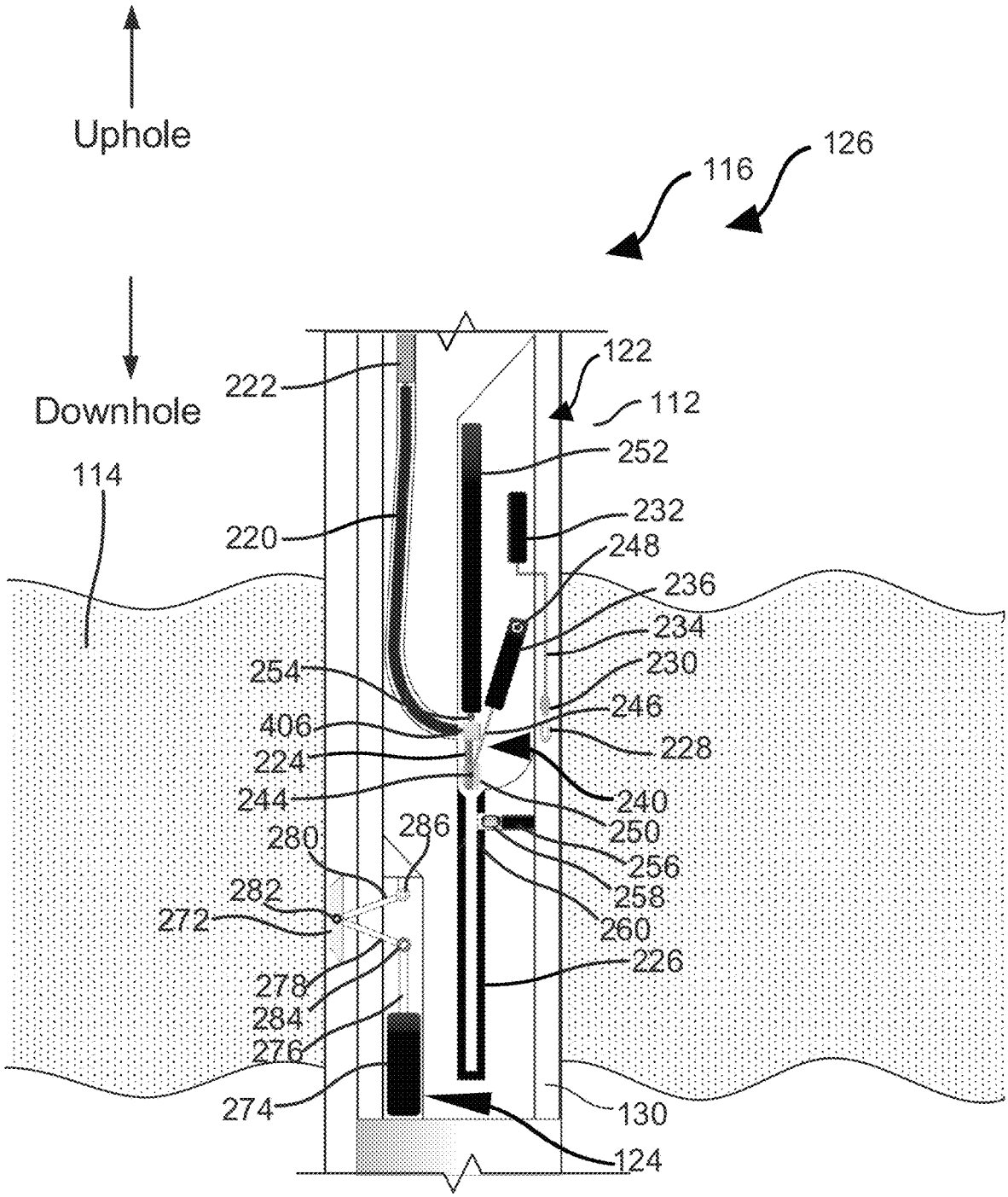
FIG. 3 is a detailed view of the sidewall core sampling tool of FIG. 1 with a coring bit in another position.

As can be seen in FIGS. 2 and 3, the coring bit 224 is coupled to a rotatable actuator 236 to enable rotation of the coring bit 224 between a neutral position 238 (as shown in FIG. 2) and a core depositing position 240 (e.g., as shown in FIG. 3). For example, as depicted in FIG. 2, the coring bit 224 is positioned within a cylindrical, rotatable bit housing 250, and the bit housing 250 is coupled to an actuator 236 at a rotatable joint 244 via a connecting rod 246. In addition, the actuator 236 is coupled to the body of the second compartment 122 by a rotatable joint 248 that allows for rotation of the actuator 236. As a result, when the actuator 236 extends the connecting rod 246, force is applied to the bit housing 250 through the connecting rod 246, which causes both the actuator 236 and the bit housing 250 to rotate clockwise. Rotation of the bit housing 250 caused by extension of the connecting rod 246 in turn causes rotation of the coring bit 224 from the neutral position 238 depicted in FIG. 2 to the core depositing position 240 depicted in FIG. 3. The rotatable bit housing 250 can also help align and guide the coring bit 224 as it is extended through the opening 228 to collect core samples from the subterranean zone 114.

Referring to FIGS. 2, 3, 4A-4C, and 5A-5C, the coring bit 224 is attached to the end of the flexible drilling shaft 132 by a pair of knuckle joints 402, 404. In some implementations, the pair of knuckle joint 402, 404 can automatically lock in order to maintain the coring bit 224 is a fixed horizontal position to the relative housing 130 of the bottom hole assembly 126 during core sampling operations. In some implementations, the knuckle joints 402, 404 are auto-lock knuckle joints. In addition, the sidewall core sampling tool 116 can include a joint lock pin releaser 406 that is configured to unlock the pair of knuckle joints 402, 404 to allow the coring bit 224 to rotate freely such that the actuator 236 be used can rotate the coring bit 224 from the neutral position 238 to the core depositing position 240.

Figure 4A:
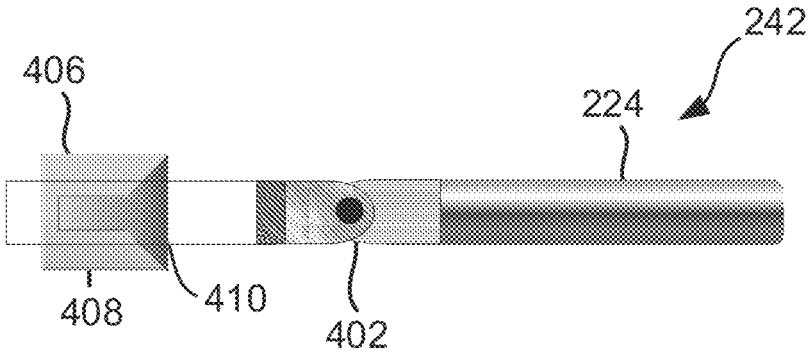
FIGS. 4A-4C depict side views of the coring bit of the sidewall core sampling tool of FIG. 1.
Figure 5A:
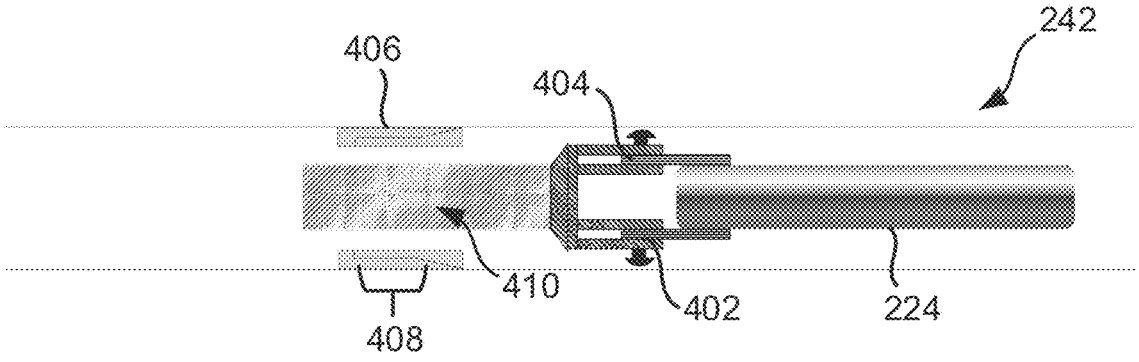
FIGS. 5A-5C depict top views of the coring bit of the sidewall core sampling tool of FIG. 1.
Figure 10:
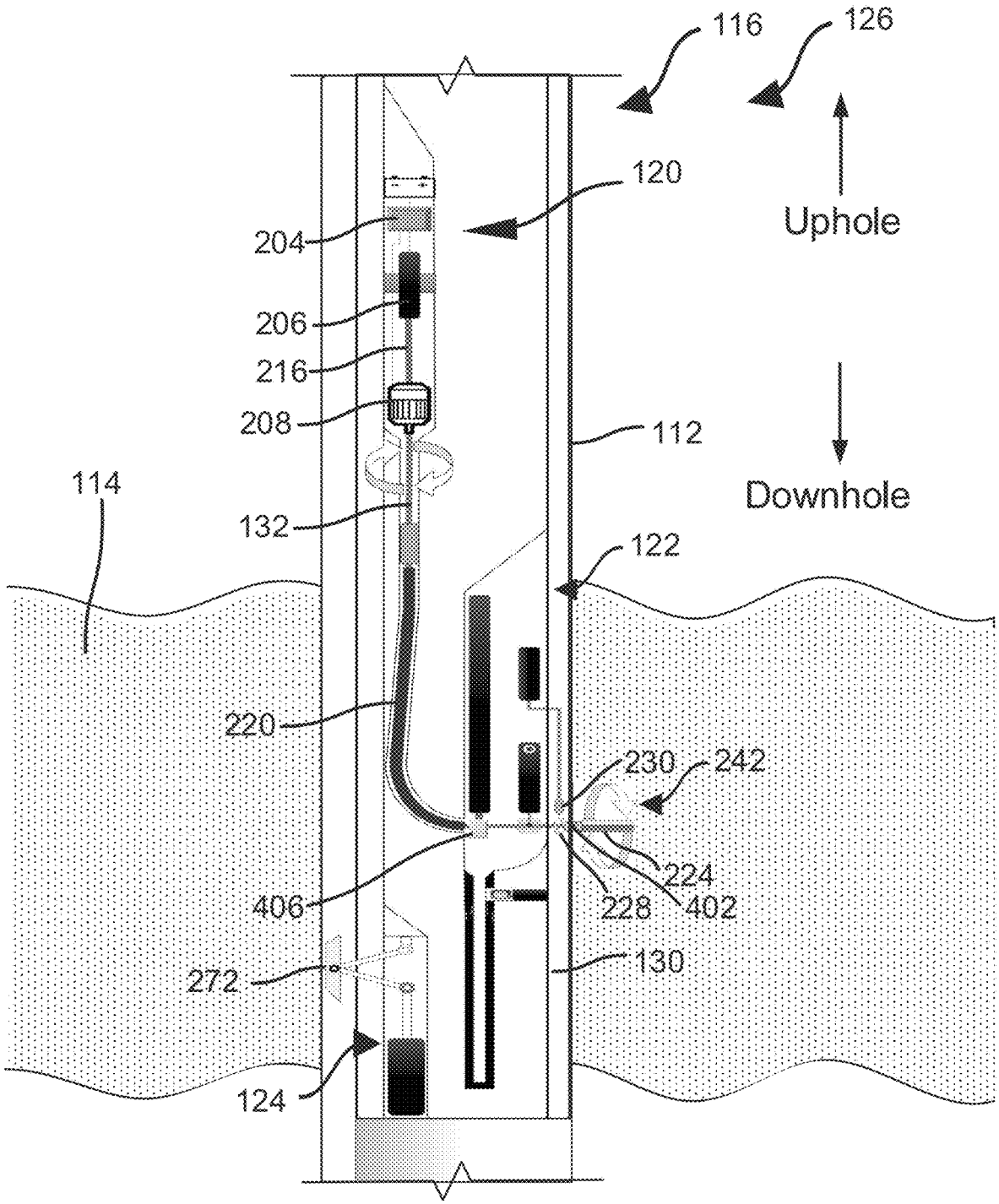

Referring to FIGS. 2, 4A, and 5A, as the actuator 206 extends the connecting rod 216 coupled to the motor 208, a downward force is applied to the drilling shaft 132, which is converted into a horizontal force applied the coring bit 224 due to the curve in the drilling shaft 132 formed by the linear bearing 220 and the connection of the coring bit 224 to the drilling shaft 132. As a result, when the sealing door 230 is raised and the motor 208 is lowered by actuator 206, the coring bit 224 is pushed out of the second compartment 122 through the opening 228 in the second compartment 122 into a sampling position 242, as depicted in FIGS. 4A, 5A, and 10. As will be described in further detail herein, once the coring bit 224 is positioned in the sampling position 242, the motor 208 can be further lowered by the actuator 206 in order to press the end of the coring bit 224 against the wellbore 112, and the motor can be operated to rotate the drilling shaft 132, which rotates the coring bit 224 into the sidewall of the wellbore 112. As the coring bit 224 is rotated and pressed against the wellbore 112 via drilling shaft 132, a core sample from the formation 114 is collected within the central opening of the coring bit 224.

FIGS. 4A and 5A depict the coring bit 224 in the sampling position 242. When in the coring bit 224 is in the sampling position 242, the knuckle joints 402, 404 maintain the horizontal position of the coring bit 224 relative to the housing 130 of bottom hole assembly 126 such that the coring bit is substantially horizontal to the housing 130 of the bottom hole assembly 126 when in the sampling position 242. In addition, as depicted in FIGS. 4A and 5A, the knuckle joints 402, 404 are outside the joint lock pin releaser 406 when the coring bit 224 is positioned in the sampling position 242.

Once a core sample has been collected within the central opening of the coring bit 224, the actuator 206 can be used to draw the motor 208 uphole, which applies a force to the drilling shaft 132 and coring bit 224. As a result, the coring bit 224 is withdrawn horizontally into the second compartment 122 until the coring bit 224 is positioned within the neutral position 238, as depicted in FIGS. 2, 4B, and 5B.

Figure 4B:
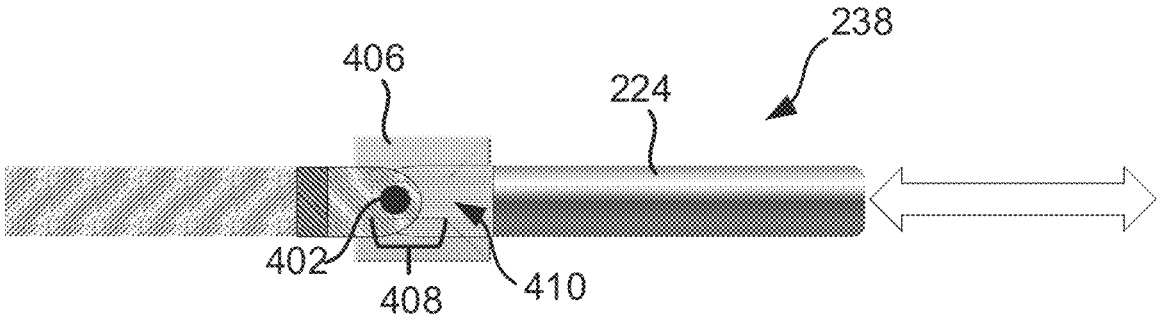
Figure 4C:
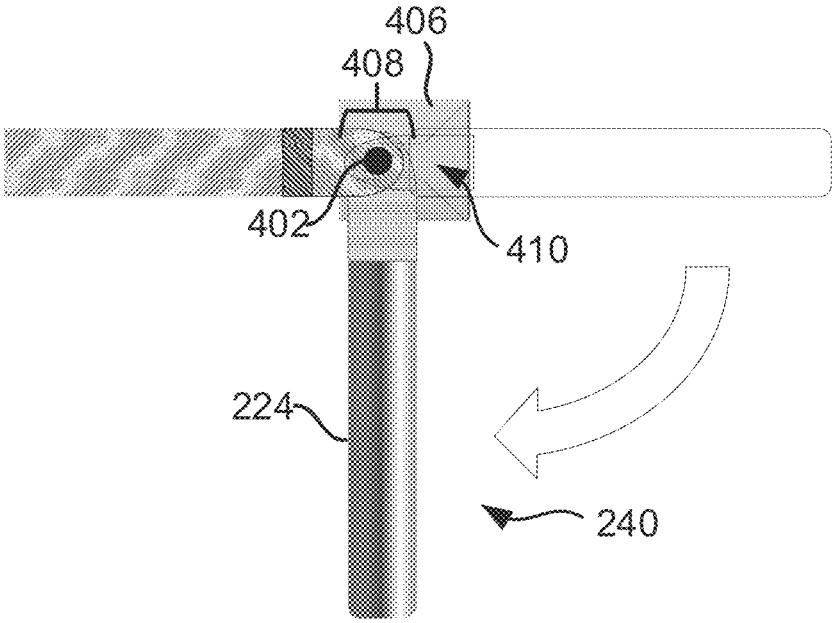
Figure 5B:
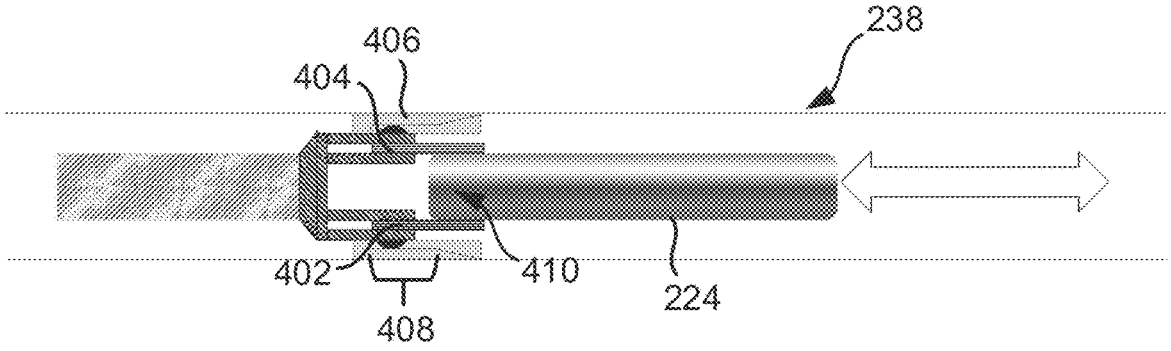
Figure 5C:
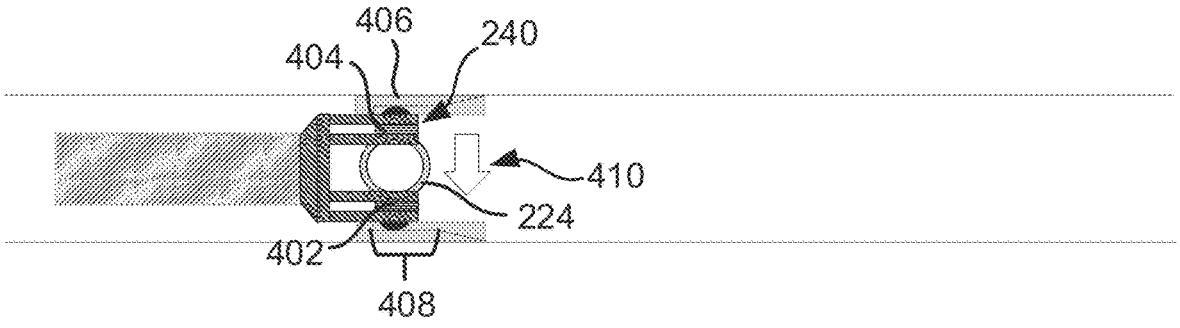

Referring to FIGS. 4B and 5B, the motor 208 and drilling shaft 132 are continually withdrawn upwards until connecting rod 216 is fully withdrawn into the actuator 206 and the knuckle joints 402, 404 coupled to the coring bit 224 are positioned within an unlocking section 408 of the joint lock pin releaser 406. For example, as can be seen in FIGS. 4A-4C and 5A-5C, the joint lock pin releaser 406 includes a central opening 410 that tapers and narrows along the length of the joint lock pin releaser 406. As the knuckle joints 402, 404 are withdrawn into the central opening 410 of the joint lock pin releaser 406, the walls of the joint lock pin releaser 406 press against the pins of knuckle joints 402, 404. Once the knuckle joints 402, 404 are positioned within an unlocking section 408 of the joint lock pin releaser 406, the pins of the knuckle joints 402, 404 are fully inserted into the respective joints 402, 404, which causes the coring bit 224 to become rotatable about the knuckle joints 402, 404. For example, once the pins of the knuckle joints 402, 404 are fully inserted into the respective joints 402, 404, the actuator 236 can extend the connecting rod 246 to rotate the coring bit 224 about the unlocked knuckle joints 402, 404 into the core depositing position 240, as depicted in FIGS. 3, 4C, and 5C.

As can be seen in FIG. 3, once the coring bit 224 has been rotated into the core depositing position 240, the end of the coring bit 224 is positioned over the core storage container 226 to allow for core samples collected by and contained within the coring bit 224 to be extracted and released into the core storage container 226. For example, as will be described in further detail herein, the second compartment 122 includes a fixed actuator 252 that can extend a core disposing pin 254 that, when extended, pushes a core sample out of the central opening of the coring bit 224 and into the core storage container 226.

In some implementations, the computer 204 monitors the length of extension of the disposing pin 254 to determine when the core storage container 226 is full. For example, once the computer 204 detects that the disposing pin 254 has extended less than a threshold length during a core deposition cycle, the computer 204 determines that the core storage container 226 is full and causes the third fixed actuator 256 to extend to push the plug 258 over the opening of the core storage container 226. In some implementations, the length of the core storage container 226 can be configured to house a predetermined number of core samples.

As can be seen in FIG. 2, the second compartment 122 includes another actuator 256 that is located proximate the opening of the core storage container 226. As will be described in further detail herein, the actuator 256 located proximate the core storage container 226 is configured to position a plug 258 over the opening of core storage container 226 once the core storage container 226 is filled with core samples. Plug 258 can be removed and the core samples contained within the core storage container 226 can be accessed once the core storage container 226 has been decoupled from the core sampling tool 116 and has reached a location for further analysis of the core samples (e.g., a laboratory). The plug 258 can be made of any suitable material for sealing the core storage container 226 including, but not limited to, rubber.

In some implementations, the core storage container 226 includes one or more threads 260, which can be used to couple the core storage container 226 to the core sampling tool 116. For example, after core sampling has been performed and the core sampling tool 116 has been retrieved to the surface 102, the core storage container 226 can be unthreaded from the core sampling tool 116 via threads 260 with plug 258 still in place to preserve the condition of the core samples contained within the core storage container 226.

Referring to FIGS. 2 and 3, in some implementations, the core sampling tool 116 includes a third compartment 124 that houses components for operating an anchor shoe 272. The anchor shoe 272 can be configured to push the core sampling tool 116 against the wellbore 112 and stabilize the core sampling tool 116. For example, as depicted in FIGS. 2 and 3, the anchor shoe 272 is positioned within the wall of the housing 130 of the bottom hole assembly 126 and exposed to the wellbore 112.

As can be seen in FIGS. 2 and 3, the anchor shoe 272 is coupled to a pair of legs 278, 280 that are coupled to the connecting rod 276 and to the third compartment 124, respectively. Each of the legs 278, 280 are coupled to the anchor shoe 272 by a knuckle joint 282. The first leg 278 is also coupled to a connecting rod 276 by a movable knuckle joint 284 and the second leg is also coupled to the third compartment 124 by a fixed knuckle joint 286.

In order to operate the anchor shoe 272 to position the core sampling tool 116 against the wellbore 112, actuator 274 extends the connecting rod 276, which causes the legs 278, 280 coupled the anchor shoe 272 to rotate about the knuckle joints 282, 284, 286 and the end of the legs 278, 280 opposite the anchor shoe 272 to move towards one another, which pushes the anchor shoe 272 outwards away from the housing 130 and towards the wellbore 112. Upon contacting the wellbore 112, the anchor shoe 272 pushes against the wellbore 112, and the force applied to the wellbore 112 by the anchor shoe 272 pushes the core sampling tool 116 towards the opposite side of the wellbore 112 such that the coring bit 224 of the core sampling tool 116 can contact the wellbore 112.

Figure 6A:
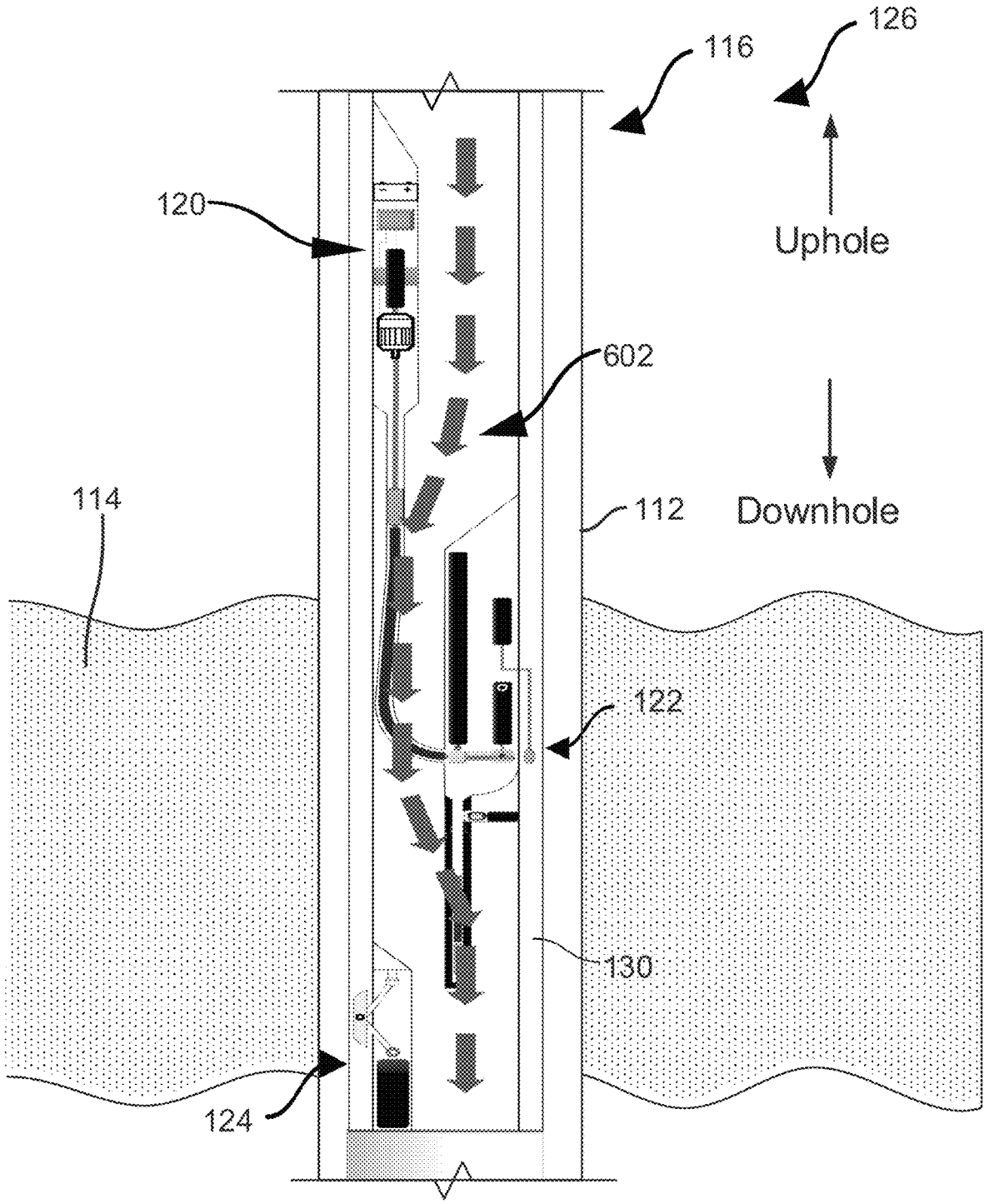
FIG. 6A depicts a schematic illustration of fluid flow through the wellbore system of FIG. 1.
Figure 6B:
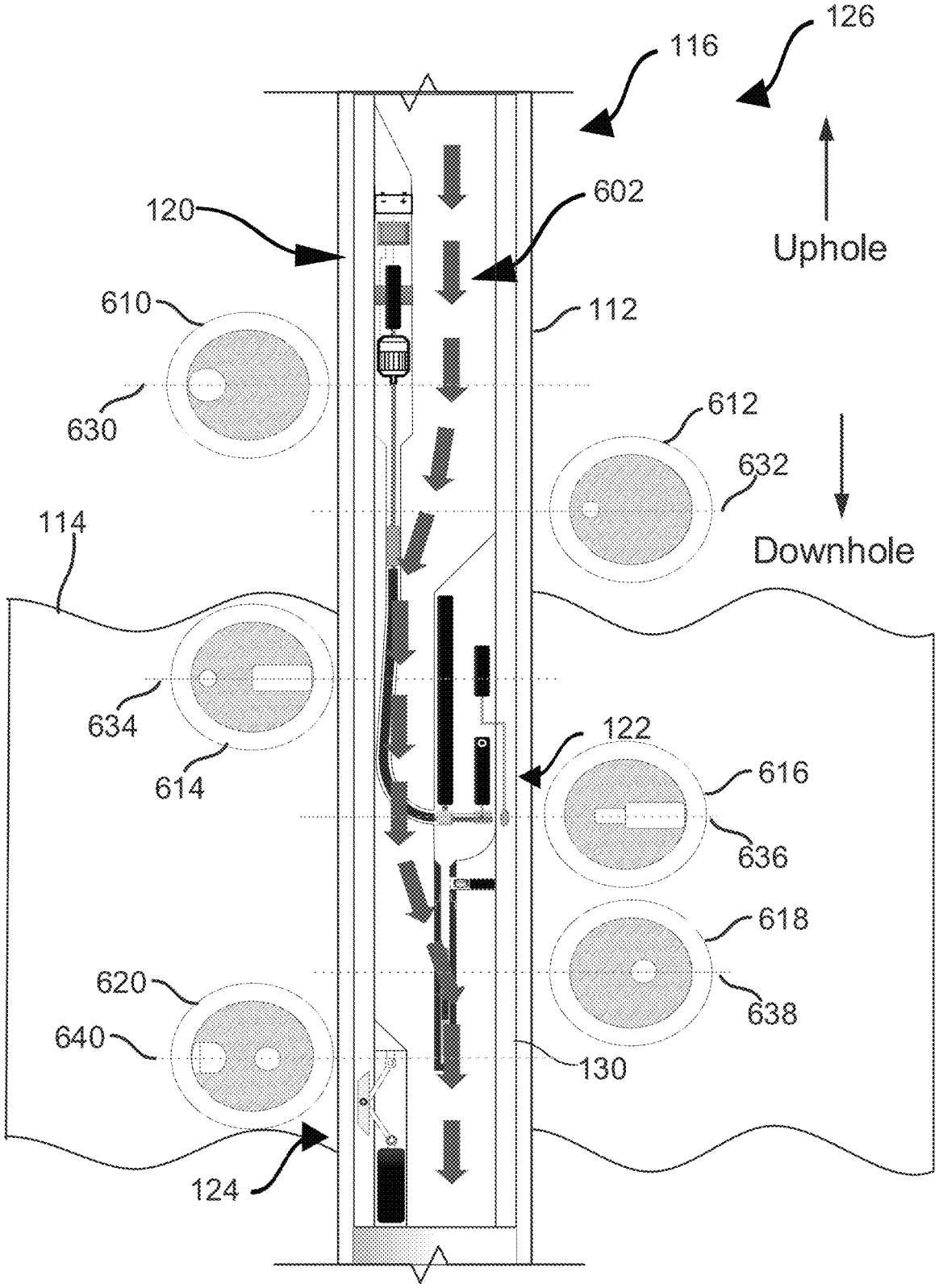
FIG. 6B depicts cross sectional views of the wellbore system of FIG. 1 with fluid flowing through the wellbore system.

As can be seen in FIGS. 1 and 6, each of the compartments 120, 122, 124 of the core sampling tool 116 is contained within the housing 130 of the bottom hole assembly 126 and is circumferentially offset from each other compartment 120, 122, 124 within the housing 130. For example, as can be seen in FIGS. 1, 6A, and 6B, the compartments 120, 122, 124 are each spaced apart from one another along the length of the housing and the second compartment 122 is radially offset from the first compartment 120 and the third compartment 124. As depicted in FIGS. 6A and 6B, the separation between each of the compartments 120, 122, 124 forms a flow path 602 such that drilling fluids, such as drilling mud, flowing through the housing 130 of the bottom hole assembly 126 can easily flow past the compartments 120, 122, 124 of the core sampling tool 116. In some implementations, the compartments 120, 122, 124 are positioned within the housing 130 such that the compartments 120, 122, 124 restrict fluid flow 602 through the housing 130 by 30% or less at any given point along the core sampling tool 116.

For example, FIG. 6B depicts cross sections 610, 612, 614, 616, 618, 620 of the housing 130 and core sampling tool 116 along various respective axes 630, 632, 634, 636, 638, 640. As can be seen in the cross sections 610, 612, 614, 616, 618, 620 depicted in FIG. 6B, the central opening through the housing 130 remains relatively clear for fluid to flow past the sampling tool 116 though the housing 130, and, as a result of the offset between the compartments 120, 122, 124, the sampling tool 116 only occupies a small portion of the cross section of the central opening through the housing 130 at any point 630, 632, 634, 636, 638, 640 along the housing 130.

A process of collecting core samples will now be described with reference to FIGS. 1 and 7-17.

Figure 7:
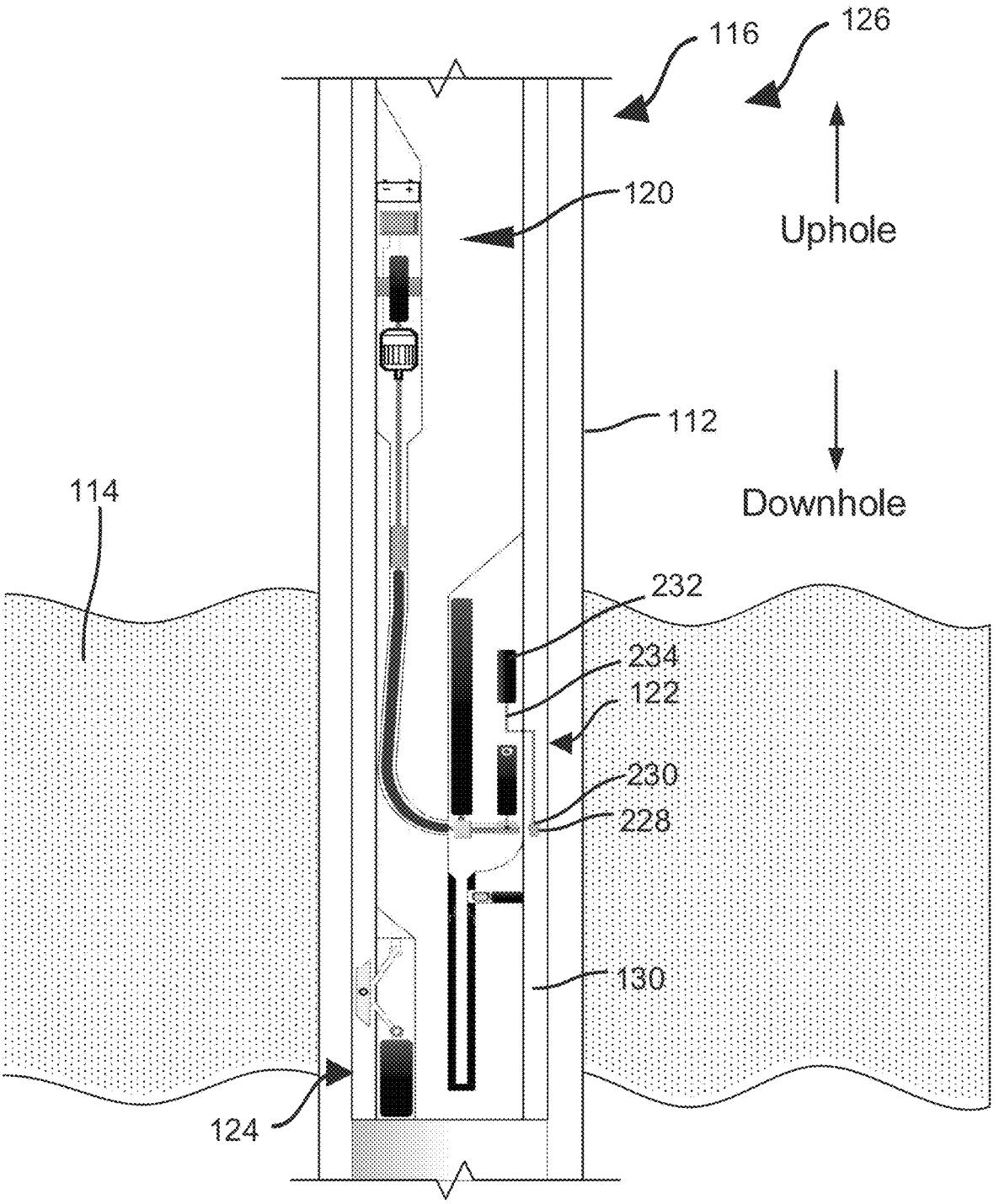
FIGS. 7-17 depict an example process of collecting core samples using the sidewall core sampling tool of FIG. 1.

Referring to FIGS. 1 and 7, the bottom hole assembly 126 is used to drill a wellbore 112. During the drilling operations (or any other time before pulling the drilling assembly 126 out of the wellbore 112, e.g., after completing drilling a targeted zone), the sidewall core sampling tool 116 can be positioned at a target depth for formation sampling. For example, the control system 125 can communicate with the core sampling tool 116 through control line 111 to determine the current depth of the core sampling tool 116 within the wellbore 112 and can control the movement of the drilling assembly 126 (and, thus, the core sampling tool 116) within the wellbore 112 to position the core sampling tool 116 at the target depth. In some implementations, the target depth for collecting core samples is selected based on borehole integrity. In some implementations, the target depth for collecting core samples is selected based on a formation evaluation generated based on integrating downhole logs and other available geoscience and engineering data, such as surface data including mud logging and drilling information.

In some implementations, upon positioning the core sampling tool 116 at the target depth, the drilling assembly 126 (and, thus, the core sampling tool 116) is rotated within the wellbore 112 in order to align the opening 228 in the housing 130 of the bottom hole assembly 126 with the targeted formation 114. For example, as depicted in FIG. 7, the bottom hole assembly 126 is positioned such that the sidewall core sampling tool 116 is positioned within the wellbore proximate the target formation 114 and the opening 228 in the housing 130 is positioned adjacent to the target formation 114.

In some implementations, prior to performing core sampling, the wellbore 112 is flushed with fluids in order to clean drill cuttings out of the wellbore 112. For example, fluid can be circulated into the wellbore 112 and through the housing 130 of the bottom hole assembly 125 in order to clean the wellbore 112.

As depicted in FIG. 7, while the drilling operations, wellbore cleaning, and positioning of the core sampling tool 116 are being performed, the sealing door 230 of the second compartment 122 is positioned over the opening 228 in the housing 130 in order to seal the opening 228 and prevent contamination of the second compartment 122 of the core sampling tool 116. For example, as depicted in FIGS. 1 and 7, while the drilling bit 128 of the bottom hole assembly 126 is being operated to extend the wellbore 112 downhole and the core sampling tool 116 is being properly positioned within the wellbore 112, actuator 232 extends connecting rod 234 to lower the sealing door 230 over the opening 228 in the housing 130 in order to prevent fluids or drill cuttings from entering the second compartment 122 through the opening 228 in the housing 130. When positioned over the opening 228, the sealing door 230 seals the interior of the second compartment 122 from the wellbore 112 to prevent the coring equipment contained within the second compartment 122 (e.g., coring bit 224) from becoming contaminated by drilling fluids and drill cuttings flowing within the wellbore 112 during drilling operations.

Figure 8:
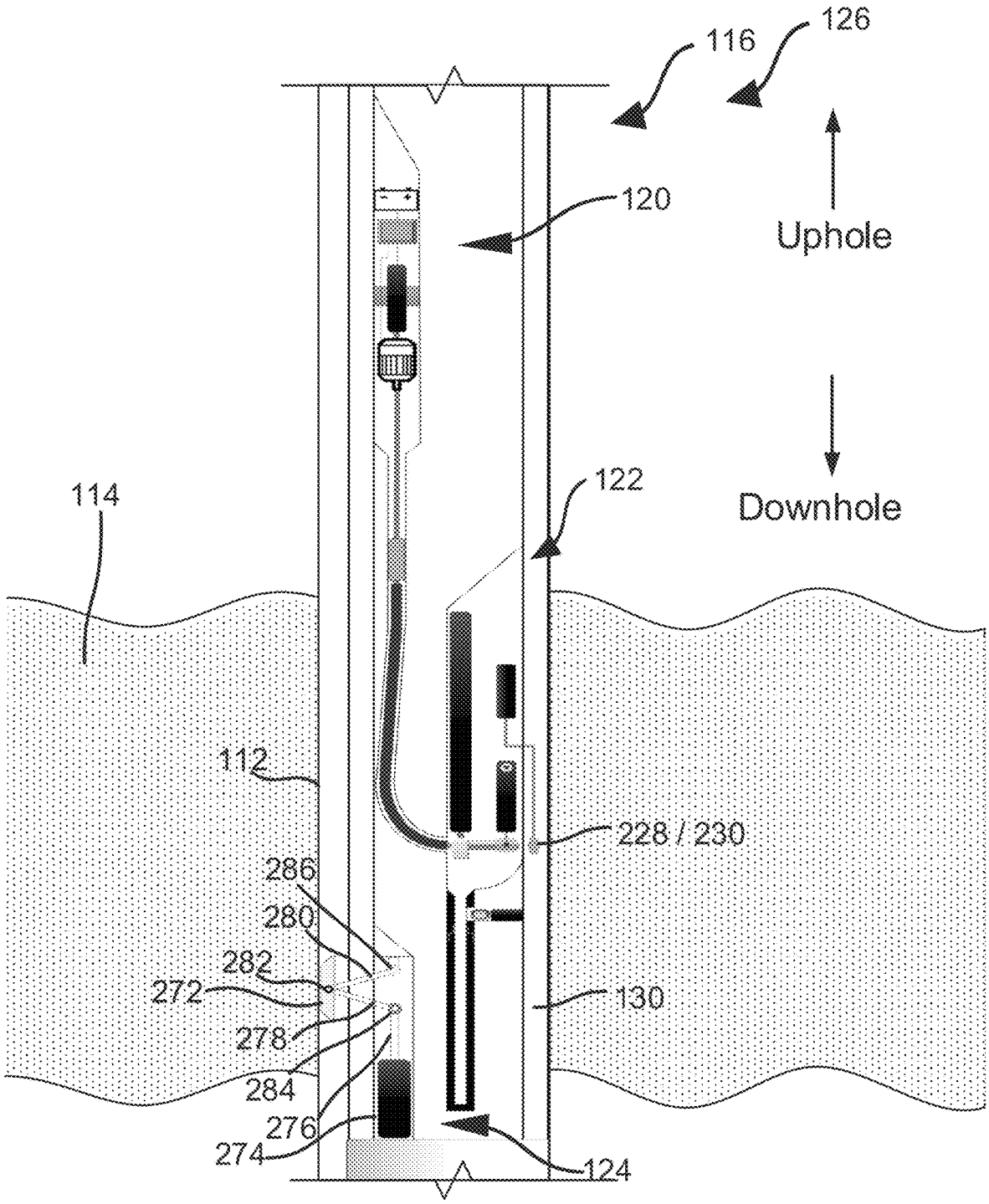

Referring to FIG. 8, once the core sampling tool 116 is positioned within the wellbore 112 proximate the target formation 114 (and any wellbore cleaning is complete), the anchor shoe 272 of core sampling tool 116 is extended from the housing 130 to anchor the drilling tool 126 and core sampling tool 116 at the target position within the wellbore 112. For example, as depicted in FIG. 8, the actuator 274 can be engaged to extend the connecting rod 276, which causes the legs 278, 280 coupled the anchor shoe 272 to rotate about the knuckle joints 282, 284, 286 and the end of the legs 278, 280 opposite the anchor shoe 272 to move towards one another, which pushes the anchor shoe 272 outwards from the housing 130 and towards the wellbore 112. Upon contacting the wellbore 112, the anchor shoe 272 pushes against the wellbore 112, and the force applied to the wellbore 112 by the anchor shoe 272 pushes the core sampling tool 116 towards the opposite side of the wellbore 112 such that the coring bit 224 can contact the wellbore 112 when in the sampling position 242.

Figure 9:
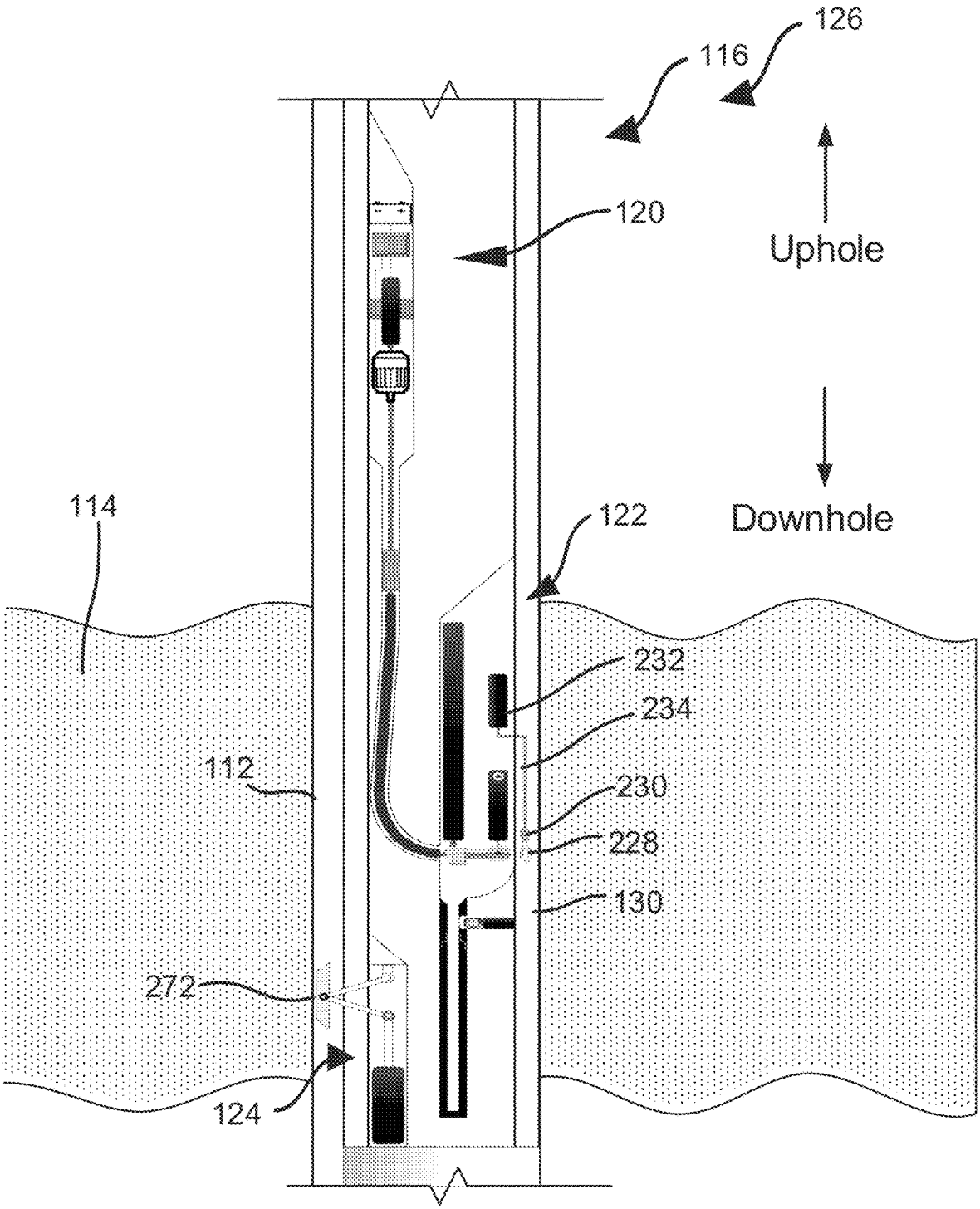

Referring to FIG. 9, once the core sampling tool 116 is positioned within the wellbore 112 proximate the target formation 114 and the anchor shoe 272 is engaged, the sealing door 230 of the second compartment 122 can be raised to expose the opening 228 through the housing 130. For example, as depicted in FIG. 9, actuator 232 can be engaged to retract the connecting rod 234 coupled to the sealing door 230, which raises the sealing door 230 to expose the opening 228 in the housing 130. In some implementations, the actuator 232 is communicably coupled to the computer 204 and the computer 204 controls the actuator to raise the sealing door 230 to expose the opening 228 once the anchor shoe 272 is engaged.

Referring to FIG. 10, once the core sampling tool 116 is positioned within the wellbore 112 proximate the target formation 114 and the sealing door 230 has been raised to expose the opening 228 in the housing 130, the coring bit 224 is extended through the opening 228 and into the wellbore 112 to collect a core sample from the target formation 114. For example, as depicted in FIG. 10, a flexible drilling shaft 132 extends from the motor 208 in the first compartment 120 through a linear bearing 220 to the coring bit 224 in the second compartment 122. The motor 208 is also coupled to an actuator 206 via a connecting rod 216. In response to determining that the sealing door 230 has been raised to expose the opening 228 through the housing 130, the actuator 206 can be controlled (e.g., by computer 204) to extend the connecting rod 216, which causes the motor 208 to move vertically downhole within the first compartment 120. As the actuator 206 extends the connecting rod 216 coupled to the motor 208, a downward force is applied to the drilling shaft 132, which is converted into a horizontal force applied to the coring bit 224 due to the curve in the drilling shaft 132 formed by the linear bearing 220 and the connection of the coring bit 224 to the drilling shaft 132. As a result, the coring bit 224 is pushed out of the second compartment 122 through the opening 228 in the housing 130 into a sampling position 242, as depicted in FIG. 10.

Once the coring bit 224 is positioned in the sampling position 242, the motor 208 can be further lowered by the actuator 206 to press the end of the coring bit 224 against the wellbore 112. In addition, the motor 208 can be engaged (e.g., by computer 204) to rotate the drilling shaft 132, which rotates the coring bit 224 into the sidewall of the wellbore 112 to obtain a core sample from the target formation 114. In some implementations, the motor 208 is rotated clockwise, which results in clockwise rotation of the coring bit 224 into the formation 114, as depicted in FIG. 10. As the coring bit 224 is rotated and pressed against the surface of the wellbore 112 via drilling shaft 132, a core sample from the formation 114 is collected within the central opening of the coring bit 224.

While the coring bit 224 is in the sampling position 242, the knuckle joints 402, 404 can be used to maintain the position of the coring bit 224 relative to the bottom hole drilling tool 126 such that the coring bit is substantially horizontal to the housing 130 of the bottom hole drilling tool 126 when in the sampling position 242. For example, as depicted in FIGS. 4A, 5A, and 10, the knuckle joints 402, 404 are outside the joint lock pin releaser 406 while the coring bit 224 is positioned in the sampling position 242 and maintain the horizontal position of the coring bit 224 during sampling.

Figure 11:
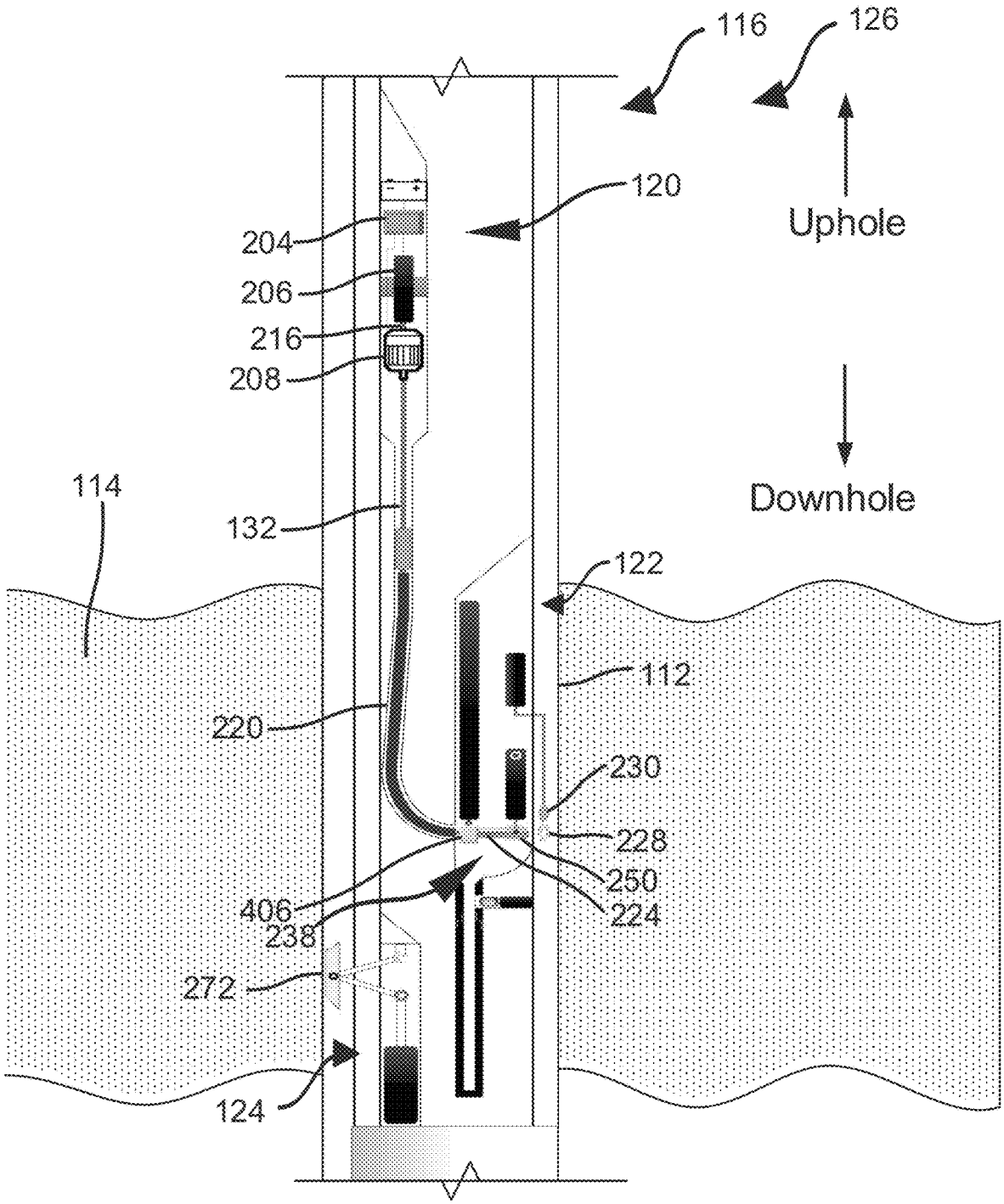

Referring to FIG. 11, once a core sample has been collected by the coring bit 224 from the target formation 114, the coring bit 224 is withdrawn back into the second compartment 122 through the opening 228. For example, as depicted in FIG. 11, once a core sample is obtained, the computer can control the motor 208 to stop rotating, which stops the rotation of the coring bit 224. In addition, the actuator 206 can be controlled (e.g., by computer 204) to retract the connecting rod 216, which causes the motor 208 to move vertically uphole within the first compartment 120. As the actuator 206 retracts the connecting rod 216, an upward force is applied to the drilling shaft 132, which is converted into a horizontal force onto the coring bit 224 due to the curve in the drilling shaft 132 formed by the linear bearing 220 and the connection of the coring bit 224 to the drilling shaft 132. As a result, the coring bit 224 is withdrawn into the second compartment 122 through the opening 228 in the housing 130 in a neutral position 238, as depicted in FIG. 11.

The coring bit 224 continues to be withdrawn into the second compartment 122 until the joint lock pin releaser 406 releases the knuckles joints of the coring bit 224 so that the coring bit 224 can be transitioned into the core depositing position 240. For example, as depicted in FIGS. 4A-4C, 5A-5C, and 11, the motor 208 and drilling shaft 132 can be continually drawn upwards until connecting rod 206 is fully withdrawn into the actuator 206 and the knuckle joints 402, 404 are positioned within an unlocking section 408 of the joint lock pin releaser 406. For example, as can be seen in FIGS. 4A-4C and 5A-5C, the joint lock pin releaser 406 includes a central opening 410 that tapers and narrows along the length of the joint lock pin releaser 406. As the knuckle joints 402, 404 are withdrawn into the central opening 410 of the joint lock pin releaser 406, the walls of the joint lock pin releaser 406 press against the pins of knuckle joints 402, 404. Once the knuckle joints 402, 404 are positioned within an unlocking section 408 of the joint lock pin releaser 406, the pins of the knuckle joints 402, 404 are fully inserted into the respective joints 402, 404, causing the coring bit 224 to be rotatable about the knuckle joints 402, 404.

Figure 12:
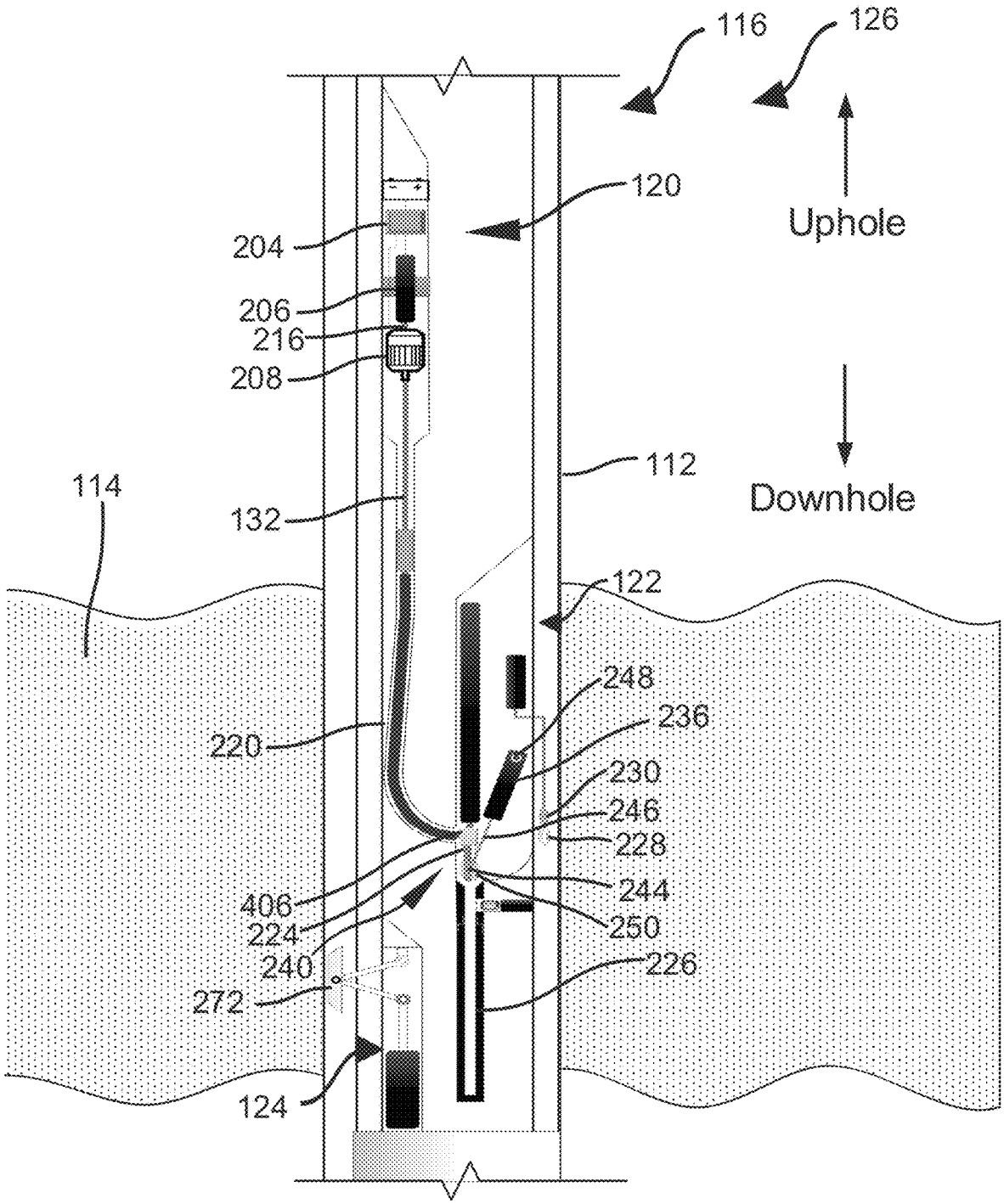

Referring to FIG. 12, once the knuckle joints of the coring bit 224 (e.g., knuckle joints 402, 404 of FIGS. 5A-5C) are unlocked, the actuator 236 can rotate the coring bit 224 into a core depositing position 240. For example, as depicted in FIGS. 11 and 12, whenever the coring bit 224 is withdrawn into the second compartment 122, the coring bit 224 is positioned within a cylindrical, rotatable bit housing 250. The rotatable bit housing 250 is coupled to an actuator 236 at a rotatable joint 244 via connecting rod 246. In addition, the actuator 236 is coupled to the body of the second compartment 122 by a rotatable joint 248 that allows for free rotation of the actuator 236. As a result, when the knuckle joints 402, 404 coupled to the coring bit 224 are unlocked, the computer 204 can control the actuator 236 to extend the connecting rod 246, which causes a downward force to be applied to the bit housing 250 through the connecting rod 246. As a result, both the actuator 236 and the bit housing 250 rotate clockwise, which rotates the coring bit 224 from the neutral position 238 depicted in FIG. 11 to the core depositing position 240 depicted in FIG. 12.

Figure 13:
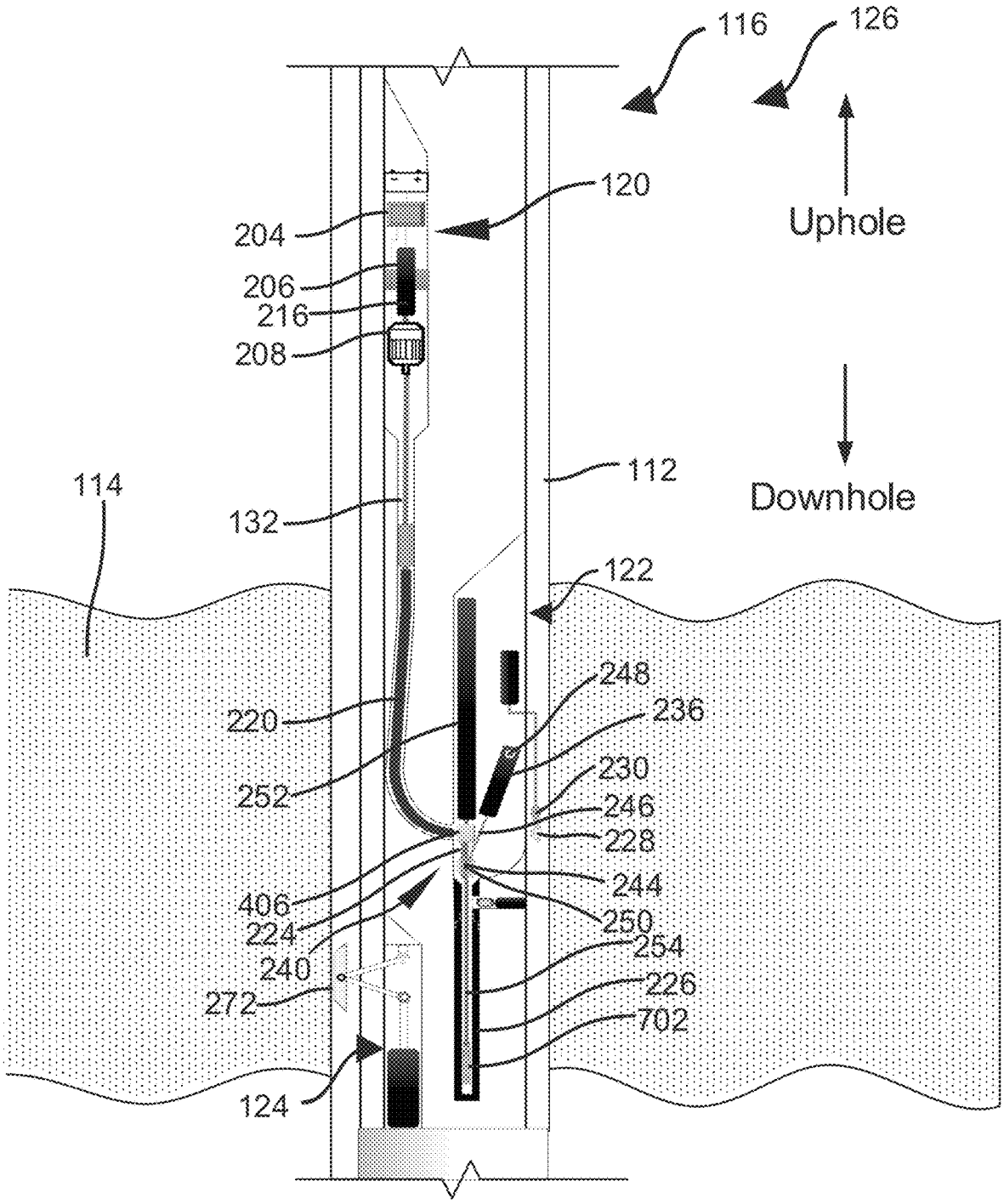

Referring to FIG. 13, once the coring bit 224 is positioned in the core depositing position 240, the core sample 702 collected by and contained within the coring bit 224 is extracted from the coring bit 224 and stored in the core storage container 226 of the second compartment. For example, as depicted in FIG. 13, once the coring bit 224 has been rotated into the core depositing position 240, the end of the coring bit 224 is positioned over the core storage container 226 to allow for the core sample collected by and contained within the coring bit 224 to be extracted and released in to the core storage container 226.

As depicted in FIGS. 12 and 13, the second compartment 122 includes a fixed actuator 252 that is coupled to a core disposing pin 254. As can be seen in FIG. 13, once the coring bit 224 is positioned in the core depositing position 240, the computer 204 can control the fixed actuator 252 to extend the core disposing pin 254, which causes the core disposing pin 254 to extend through the central opening of the coring bit 224. As the core disposing pin 254 extends through the central opening of the coring bit 224, the core sample 702 contained within the coring bit 224 is pushed out of the central opening of the coring bit 224 and into the core storage container 226. In some implementations, the actuator 252 continues to extend the core disposing pin 254 until a threshold resistance on the core disposing pin 254 is detected, indicating that the core sample 702 is fully inserted into the core storage container 226 (e.g., onto the bottom of the container 226 or onto the core sample last added to the container 226).

Figure 14:
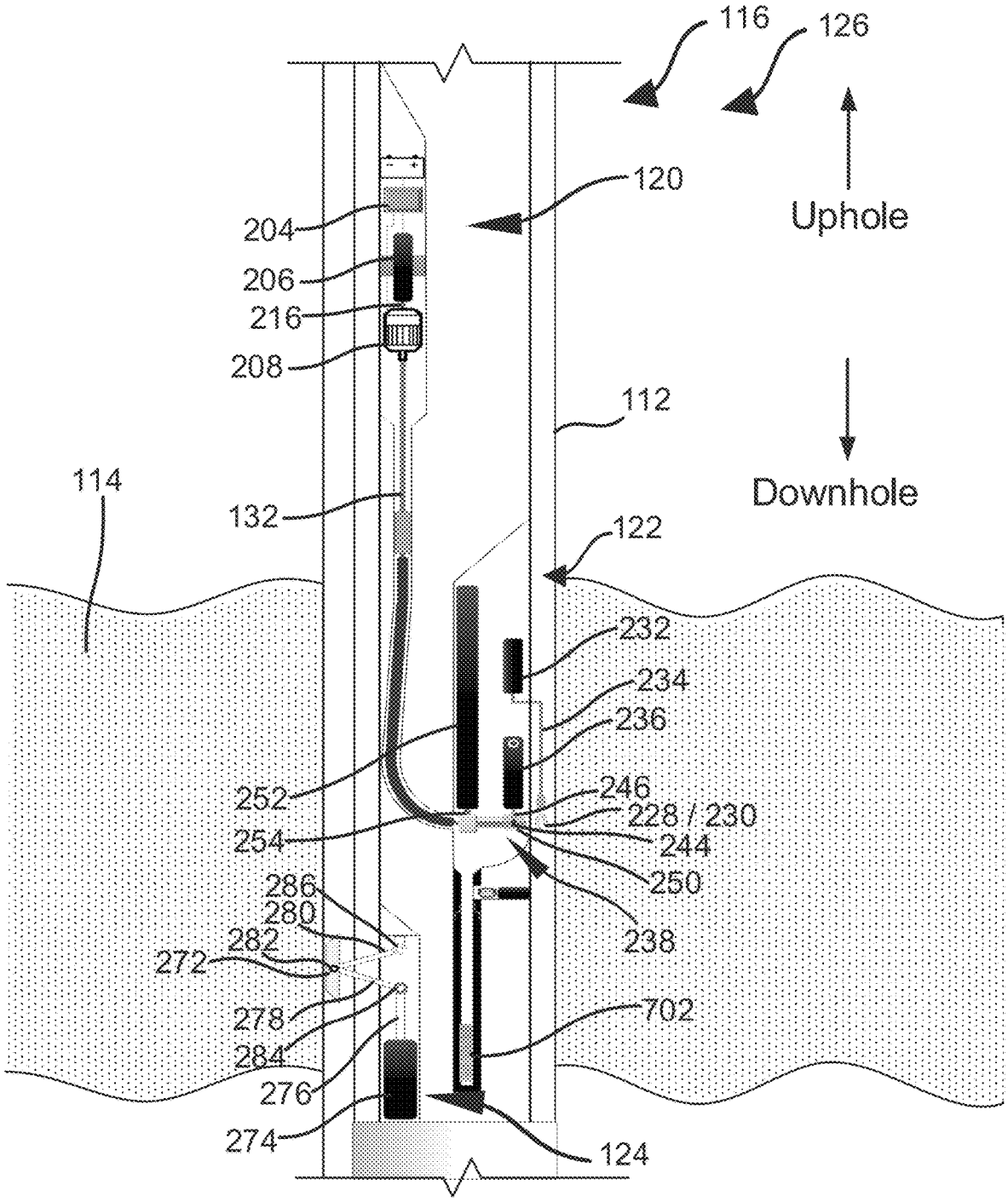

Referring to FIG. 14, once the core sample 702 has been extracted from the coring bit 224 and placed within the core storage container 226, the coring bit 224 can be returned to the neutral position 238. For example, the computer 204 can control actuator 252 to retract the core disposing pin 254. In addition, the computer 204 can control actuator 236 to retract connecting rod 246, which causes an upward force to be applied to the bit housing 250 through the connecting rod 246. As a result, both the actuator 236 and the bit housing 250 rotate counterclockwise, which rotates the coring bit 224 from the core depositing position 240 depicted in FIGS. 12 and 13 to the neutral position 238 depicted in FIG. 14.

Still referring to FIG. 14, once the core sample 702 has been extracted from the coring bit 224 and placed within the core storage container 226, the core sampling tool 116 can be moved and repositioned within the wellbore 112 to collect one or more additional core samples. For example, after placing the core sample 702 into the core storage container 226, the computer 204 can control actuator 232 to extend the connecting rod 234 coupled to the sealing door 230, which lowers the sealing door 230 over the opening 228 in the housing 130. By lowering the sealing door 230 over the opening 228, the second compartment 122 is sealed from the wellbore 112 while the core sampling tool 116 is being repositioned within the wellbore 112. In addition, as depicted in FIG. 14, the computer 204 can control actuator 274 to retract the connecting rod 276 coupled to the leg 278 of the anchor shoe 272, which causes the legs 278, 280 coupled the anchor shoe 272 to rotate about the knuckle joints 282, 284, 286 and the end of the legs 278, 280 opposite the anchor shoe 272 move away from one another. As a result, the anchor shoe 272 is drawn towards the housing 130 of the bottom hole assembly 126 and away from the surface of the wellbore 112, which dislodges the drilling assembly 126 from the wellbore 112.

Once the sealing door 230 is positioned to seal opening 228 and the anchor shoe 272 is withdrawn from the surface of the wellbore 112, the bottom hole assembly 126 can be repositioned within the wellbore 112 for additional core sampling. For example, the bottom hole assembly 126 can be raised or lowered within the wellbore 112 to position the sidewall core sampling tool 116 proximate a second target formation for core sampling. Once the sidewall core sampling tool 116 is positioned proximate another target formation, the process for core sampling described above in reference to FIGS. 7-14 can be repeated to collect one or more additional core samples.

Figure 15:
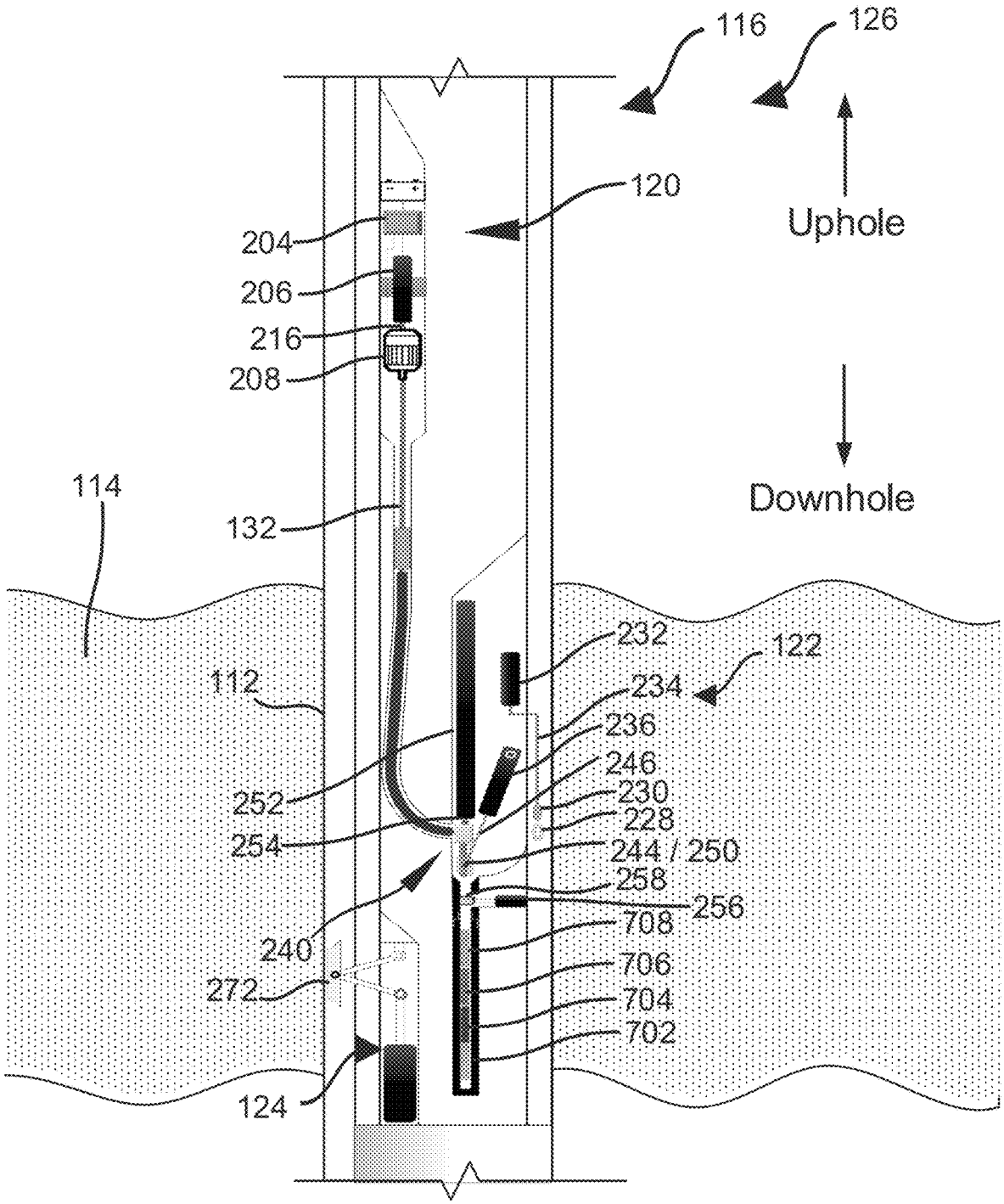

Once the core storage container 226 is filled with core samples 702, 704, 706, 708, the core storage container 226 can be sealed to protect and store the core samples 702, 704, 706, 708 for subsequent analysis. Referring to FIG. 15, the second compartment 122 includes a fixed actuator 256 proximate the opening of the core storage container 226 that is configured to position a plug 258 over the opening of core storage container 226 once the core storage container 226 is filled with core samples. For example, as can be seen in FIG. 15, once the computer 204 detects that the core storage container 226 is full, the computer 204 can control actuator 256 to extend outward to position a plug 258 coupled to the end of the actuator 256 over the core storage container 226.

Figure 16:
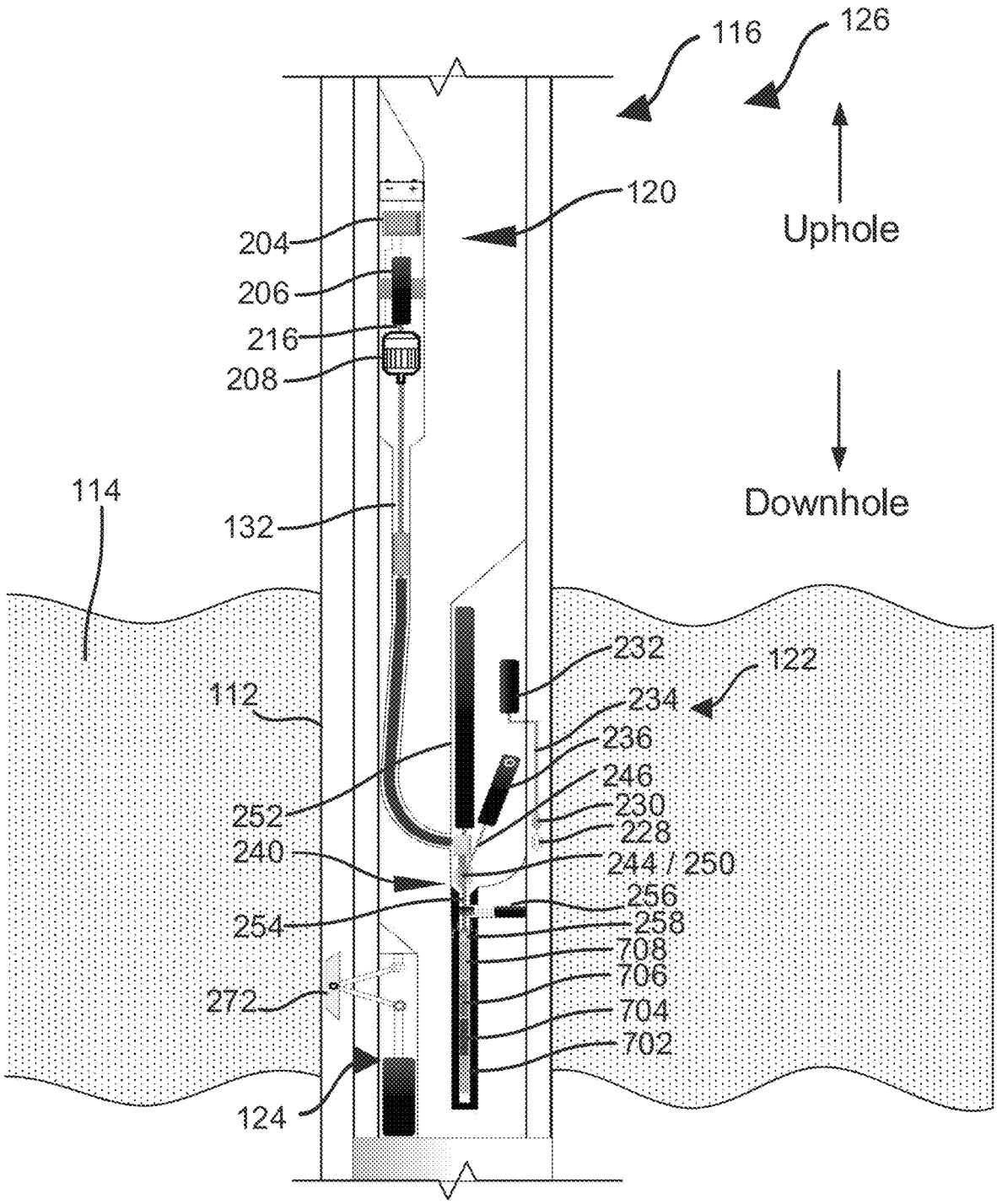

In some implementations, the computer 204 monitors the length of extension of the disposing pin 254 to determine whether the core storage container 226 is full. For example, once computer 204 detects that the disposing pin 254 has extended less than a threshold length during a sample deposition cycle, the computer 204 determines that the core storage container 226 is full and causes fixed actuator 256 to extend and position the plug 258 over the opening of the core storage container 226. As depicted in FIGS. 15 and 16, if the computer 204 determines that the core storage container 226 is full after depositing a core sample 708 into the core storage container 226, the computer 204 controls actuator 236 to maintain the coring bit 224 in the core depositing position 240 during the process of sealing the core storage container 226.

Referring to FIG. 16, once actuator 256 is fully extended, which positions the plug 258 over the core storage container 226, the computer 204 controls actuator 252 to extend the core disposing pin 254 through the central opening of the coring bit 224. As the core disposing pin 254 extends, the core disposing pin 254 pushes the plug 258 into the core storage container 226. In some implementations, the actuator 252 continues to extend the core disposing pin 254 until a threshold resistance on the core disposing pin 254 is detected, indicating that the plug 258 is fully inserted into and sealing the core storage container 226.

Figure 17:
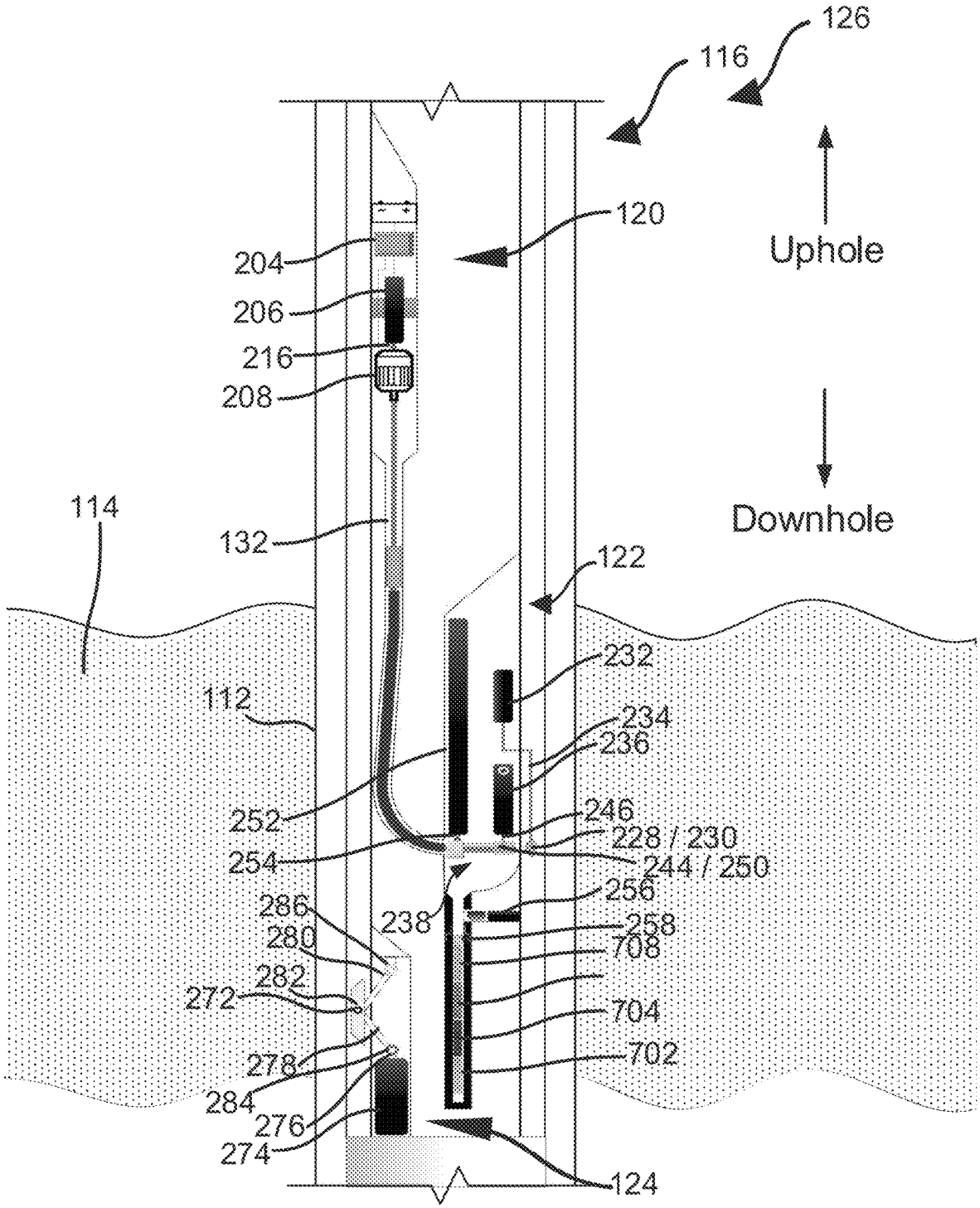

Referring to FIG. 17, once the core storage container 226 is sealed using the plug 258, the computer 204 can control actuator 252 to retract the core disposing pin 254. In addition, the coring bit 224 can be returned to the neutral position 238. For example, the computer 204 can control the actuator 236 to retract the connecting rod 246, which causes an upward force to be applied to the bit housing 250 through the connecting rod 246. As a result, both the actuator 236 and the bit housing 250 rotate counterclockwise, which rotates the coring bit 224 from the core depositing position 240 depicted in FIGS. 15 and 16 to the neutral position 238 depicted in FIG. 17.

Further, once the core storage container 226 is sealed with plug 258, the bottom hole assembly 126 can be repositioned within the wellbore 112 for additional drilling operations or can be withdrawn from the wellbore 112 (e.g., if drilling operations are complete). For example, as depicted in FIG. 17, after sealing the core storage container 226 with plug 258, the computer 204 can control actuator 232 to extend the connecting rod 234 coupled to the sealing door 230, which lowers the sealing door 230 over the opening 228 in the housing 130. By lowering the sealing door 230 over the opening 228, the second compartment 122 is sealed from the wellbore 112 during movement of bottom hole assembly 126 within the wellbore 112. In addition, as depicted in FIG. 17, once the core storage container 226 is sealed with plug 258, the computer 204 can control actuator 274 to retract the connecting rod 276 coupled to the leg 278 of the anchor shoe 272, which causes the legs 278, 280 coupled the anchor shoe 272 to rotate about the knuckle joints 282, 284, 286 and the end of the legs 278, 280 opposite the anchor shoe 272 move away from one another. As a result, the anchor shoe 272 is drawn towards the housing 130 of the bottom hole assembly 126 and away from the surface of the wellbore 112, which dislodges the drilling assembly 126 from the wellbore 112, allowing the drilling assembly 126 to be moved freely within the wellbore 112.

Once core sampling and drilling operations are completed, the bottom hole assembly 126 and core sampling tool 116 can be withdrawn uphole and out of the wellbore 112. Once the core sampling tool 116 has been retrieved to the surface 102, the core storage container 226 can be unthreaded from the core sampling tool 116 via threads 260 with plug 258 still in place to preserve the condition of the core samples 702, 704, 706 708 contained within the core storage container 226 during transport of the core storage container 226. Once the core storage container 226 has been decoupled from the core sampling tool 116 and transported to a location for analysis of the core samples (e.g., a laboratory), plug 258 can be removed and the core samples

702, 704, 706 708 contained within the core storage container 226 can be accessed for analysis.

While the core sampling tool 116 has been depicted as being deployed in a vertical wellbore, some implementations, the core sampling tool 116 can be used in a horizontal wellbore. For example, when deploying the core sampling tool 116 in a horizontal wellbore, the bottom hole assembly 126 and core sampling tool 116 can be rotated to orient the opening 228 in the housing 130 to face the direction of gravity. In addition, when the core sampling tool 116 is deployed in a horizontal wellbore, the use of an anchor shoe (such as anchor shoe 272) may not be required as the housing 130 of the bottom hole assembly 126 can rest against the horizontal wellbore.

While this specification contains many specific implementation details, these should not be construed as limitations on the scope of any claims or of what may be claimed, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A system comprising:
a bottom hole assembly comprising:
a housing; and
a drill bit coupled to the housing; and
a core sampling tool comprising:
a first compartment positioned within the housing, the first compartment comprising a motor, wherein the first compartment further comprises a first actuator configured to raise and lower the motor within the first compartment;
a second compartment positioned within the housing and radially spaced apart from the first compartment, the second compartment comprising a coring bit; and
a flexible drilling shaft extending between and coupled to the motor and the coring bit.

2. The system of claim 1, wherein the first compartment and the second compartment are vertically spaced apart within the housing of the bottom hole assembly.

3. The system of claim 1, wherein:
the second compartment further comprises:
an opening through the housing; and
a sealing door configured to seal the opening; and
lowering the motor within the first compartment causes the coring bit to extend outside the second compartment through the opening when the sealing door is positioned above the opening.

4. The system of claim 3, wherein:
the second compartment comprises a second actuator configured to raise and lower the sealing door within the second compartment; and
positioning the sealing door above the opening comprises causing the second actuator to retract a connecting rod coupled to the sealing door.

5. The system of claim 3, wherein the sealing door is configured to seal the opening during drilling operations.

6. The system of claim 3, wherein the second compartment further comprises a core storage container.

7. The system of claim 6, wherein the coring bit is configured to rotate to deposit a core sample within the core storage container.

8. The system of claim 7, wherein:
the coring bit is coupled to the flexible drilling shaft using one or more locking joint pins; and
the second compartment further comprises a locking joint pin releaser configured to unlock the one or more locking joint pins coupled to the coring bit.

9. The system of claim 8, wherein the second compartment further comprises a rotatable actuator configured to rotate the coring bit within the second compartment.

10. The system of claim 9, wherein rotating the coring bit to deposit core samples within the core storage container comprises:
inserting the one or more locking joint pins into the locking joint pin releaser to unlock the one or more locking joint pins; and
actuating the rotatable actuator to rotate the coring bit within the second compartment.

11. The system of claim 10, wherein:
the second compartment comprises:
a second connecting rod coupled to the rotatable actuator; and
a rotatable bit housing coupled to the rotatable actuator, the rotatable bit housing encircling the coring bit when the coring bit is positioned with the second compartment; and
actuating the rotatable actuator to rotate the coring bit within the second compartment comprises causing the rotatable actuator to extend the second connecting rod.

12. The system of claim 4, wherein the second compartment further comprises:
a third actuator; and
a core disposing pin coupled to the third actuator.

13. The system of claim 12, wherein depositing the core sample within the core storage container comprises:
rotating the coring bit from a neutral position to a depositing position over the core storage container; and
extending the core disposing pin using the third actuator through the coring bit.

14. The system of claim 12, wherein the second compartment further comprises:

a fourth actuator; and a plug coupled the fourth actuator and configured to seal the core storage container.

15. The system of claim 14, wherein sealing the core storage container comprises:

determining that the core storage container is full;

in response to determining that the core storage container is full, actuating the fourth actuator to position the plug over the core storage container; and inserting the plug into the core storage container.

16. The system of claim 15, wherein inserting the plug into the core storage container comprises extending the core disposing pin using the third actuator to press the plug into the core storage container.

17. The system of claim 16, further comprising:

an anchor shoe configured to stabilize the bottom hole assembly within a wellbore; and a third compartment within the housing, the third compartment comprising:

a fifth actuator;

a first leg rotatably coupled to the anchor shoe and the fifth actuator; and a second leg rotatably coupled to the anchor shoe and the third compartment.

18. The system of claim 17, wherein the third compartment is vertically spaced apart from the first compartment and the second compartment and radially spaced apart from the second compartment within the housing.

19. A core sampling tool comprising:

a first compartment positioned within a housing, the first compartment comprising a motor;

a second compartment positioned within the housing and radially spaced apart from the first compartment, the second compartment comprising a coring bit configured to cut core samples from a targeted formation, wherein the first compartment further comprises an actuator configured to raise and lower the motor within the first compartment; and a flexible drilling shaft extending between and coupled to the motor and the coring bit.

* * * * *